US006414703B1

(12) United States Patent
Sugiyama et al.

(10) Patent No.: US 6,414,703 B1
(45) Date of Patent: Jul. 2, 2002

(54) THERMAL PRINTER AND METHOD OF DESIGNING HOT CATHODE FLUORESCENT TUBE FOR THERMAL PRINTER

(75) Inventors: Hayami Sugiyama; Toshiki Nakamura; Hideki Maeda; Haruki Takeuchi; Kawabe Morio; Shintaro Okamoto, all of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/924,432

(22) Filed: Aug. 8, 2001

(30) Foreign Application Priority Data

Aug. 11, 2000 (JP) ..... 12-245363
Dec. 28, 2000 (JP) ..... 12-402276
Jul. 4, 2001 (JP) ..... 13-203981

(51) Int. Cl.[7] ..... B41M 5/26; B41M 5/34; B41J 2/32; B41J 2/315

(52) U.S. Cl. ..... 347/175

(58) Field of Search ..... 347/175, 102, 347/212; 430/97

(56) References Cited

U.S. PATENT DOCUMENTS 4,417,172 A 11/1983 Touhou et al. ..... 313/156
4,692,661 A 9/1987 Moskowitz et al. ..... 313/485
4,698,547 A 10/1987 Grossman et al. ..... 313/485
4,833,488 A * 5/1989 Mizutani et al. ..... 347/175
5,825,396 A * 10/1998 Fujishiro ..... 347/175

FOREIGN PATENT DOCUMENTS

EP 0111297 * 5/1984

* cited by examiner

*Primary Examiner*—Huan Tran
(74) *Attorney, Agent, or Firm*—Darby & Darby

(57) ABSTRACT

This printer performs a heating process via a thermal head 1 on TA paper 11 provided with color forming layers and fixes the heat processed TA paper 11 via a fixing lamp 7. The fixing lamp 7 is formed from: a fluorescent tube that has a fluorescent coating applied to the inside surface of the glass tube and inside which are sealed mercury and noble gases; filament electrodes provided at both ends of the fluorescent tube; a hot cathode fluorescent lamp formed from lead wires that supply power to the filament electrodes; and a magnetic circuit that is provided on a side surface of the fluorescent tube and that generates a magnetic field that acts on the current that flows through the fluorescent tube when power is fed to the filament electrodes.

23 Claims, 19 Drawing Sheets

FIG. 23A
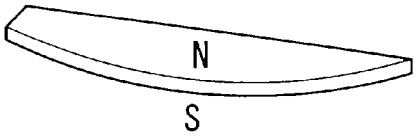
FIG. 23B
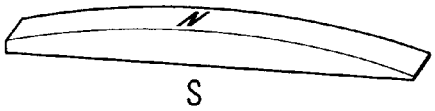
FIG. 24
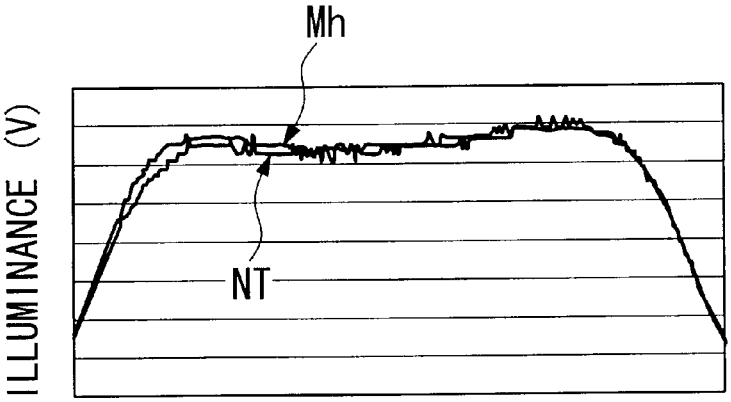
FIG. 25A
FIG. 25B
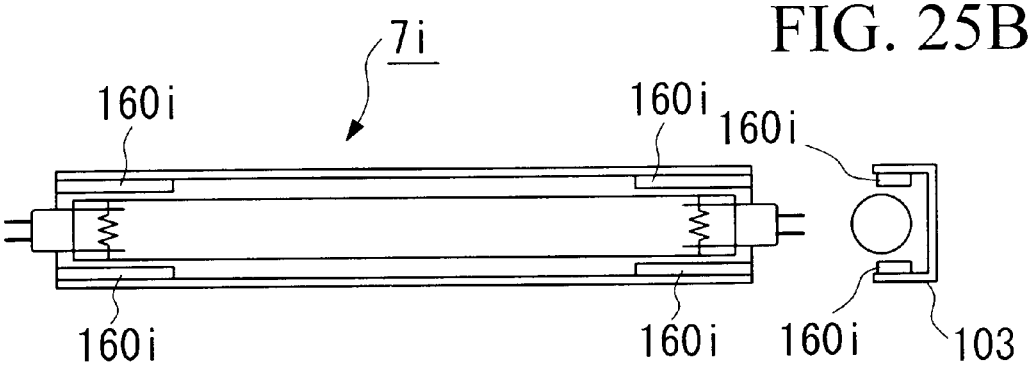

FIG. 26A
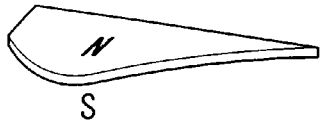
FIG. 26B
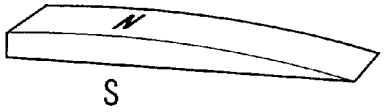
FIG. 27
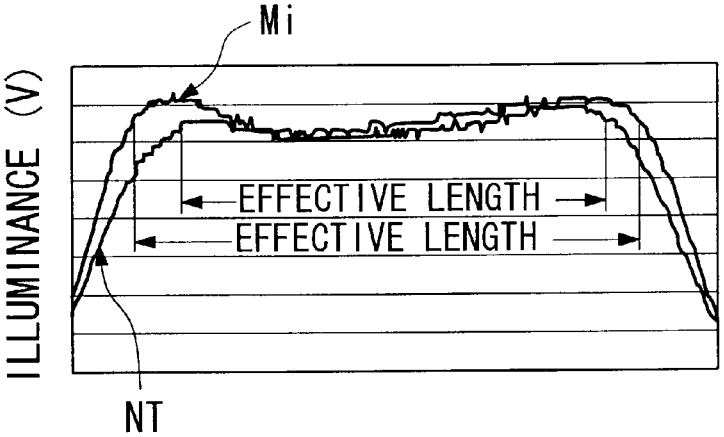
FIG. 28A
FIG. 28B
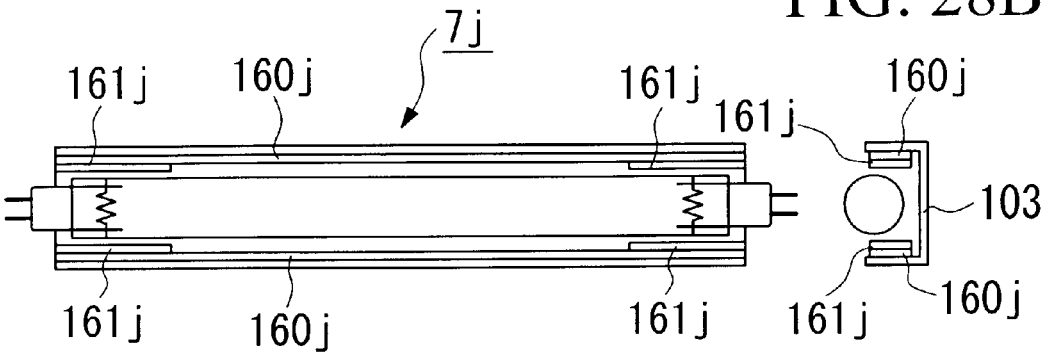

RESULTS OF MEASURING MAGNETIC FLUX DENSITY

| COORDINATES OF POINT OBSERVED (x、y) | MAGNET (LARGE MAGNETIC FORCE) | MAGNET (SMALL MAGNETIC FORCE) |
|---|---|---|
| | (x COMPONENT, y COMPONENT) | (x COMPONENT, y COMPONENT) |
| A(-8, 0) | (0.0356, 0.015) | (0.01, 0.0055) |
| B(-4, 0) | (0.0245, 0.3) | (0.0122, 0.01) |
| C( 0, 0) | (0.0, 0.038) | (0.0, 0.013) |
| D(0, -8) | (0.0, 0.1) | (0.0, 0.0526) |
| E(0, -4) | (0.0, 0.05) | (0.0, 0.0213) |
| F(0, 4) | (0.0, 0.022) | (0.0, 0.007) |
| G(0, 8) | (0.0, 0.013) | (0.0, 0.0045) |

UNITS OF MAGNETIC FLUX DENSITY: [T]

THERMAL PRINTER AND METHOD OF DESIGNING HOT CATHODE FLUORESCENT TUBE FOR THERMAL PRINTER

BACKGROUND OF THE INVENTION

1. Field of the Invention

The present invention relates to a thermal printer that achieves a reduction in print time.

2. Description of the Related Art

Conventionally, various means have been used in order to reduce the print time in color thermal printers that use thermal recording paper (referred to below as TA (Thermal-Autochrome) paper). One of these involves reducing the fixing time. Namely, in this type of printer, the ink fixing process is performed after the process to heat the thermal recording paper using the thermal head of the printer. This fixing process is carried out by light irradiated from a fluorescent lamp. The energy required to fix the ink is determined using the formula "light intensity"×"irradiation time". Therefore, conventionally, various means have been employed to increase the intensity of the light using reflective plates.

However, conventionally, no means have been employed to strengthen the light emission intensity of the fluorescent lamp.

SUMMARY OF THE INVENTION

The present invention was conceived of in view of the above circumstances, and it is an object there of to provide thermal printer in which the light emission intensity of the fluorescent lamp is increased and, as a result, a reduction in the print time is achieved.

The present invention is intended to solve the above problems and the first aspect of the present invention is a thermal printer that performs color printing by carrying out a heating process via a thermal head on thermal recording paper provided with color forming layers for performing color formation in a plurality of different colors and by fixing the thermal recording paper that has undergone heating process using a light fixing device, wherein the light fixing device comprises: a hot cathode fluorescent lamp formed from: a fluorescent tube that has a fluorescent coating applied to an inside surface of the glass tube and inside which are sealed mercury and noble gases, filament electrodes provided at both ends of the fluorescent tube, and lead wires that supply power to the filament electrodes; and a magnetic circuit that is provided on a side surface of the fluorescent tube and that generates a magnetic field that acts on current that flows through the fluorescent tube when power is fed to the filament electrodes.

According to the present invention, in a thermal printer that performs color printing by carrying out a heating process on thermal recording paper using a thermal head and then fixing the thermal recording paper that has undergone the heat processing using light fixing device, because the light fixing device is formed from a hot cathode fluorescent lamp and a magnetic circuit that is provided on a side surface of the fluorescent tube and that generates a magnetic field that acts on the current flowing through the fluorescent tube when electricity is fed to the filament electrode, it is possible to increase the light emission intensity of the fluorescent lamp without shortening the life of the hot cathode fluorescent lamp. Moreover, the effective length of the fluorescent tube is improved by flattening the illumination intensity distribution by the illumination intensity in the vicinity of the filament electrodes being increased due to the magnetic circuit. As a result, the excellent effects are obtained that the print time is shortened, and uniform fixing can be made possible with unfixed areas or over fixed areas being done away with. Furthermore, because it is possible to maintain the maximum illumination intensity for a long period of time by providing a cooling fan for cooling the fluorescent tube, the excellent effect is obtained that the operating efficiency is vastly improved when the hot cathode fluorescent lamp is used for hardening resins that are hardened by ultraviolet light or for sterilization.

The second aspect of the present invention is the thermal printer according to the first aspect, wherein the magnetic circuit comprises a frame formed with a U shaped cross section from a ferromagnetic material, and a pair of magnets positioned such that different polarities face each end of the frame, and wherein the magnetic circuit is mounted on a side surface of the fluorescent tube so as to surround a lower half of the fluorescent tube.

The third aspect of the present invention is the thermal printer according to the second aspect, wherein a reflective plate is disposed between an end portion of the magnets and the fluorescent tube.

The fourth aspect of the present invention is the thermal printer according to the second aspect, wherein a surface of the magnets that faces the fluorescent tube is curved in a shape that substantially corresponds to a surface of the fluorescent tube, and that curved surface forms the reflective plate.

The fifth aspect of the present invention is the thermal printer according to the first aspect, wherein the magnetic circuit comprises a frame formed with a U shaped cross section from a ferromagnetic material, and a pair of magnets provided at both ends of the frame, and wherein a plurality of magnets are mounted in a row on a side surface of the fluorescent tube so as to surround a lower half of the fluorescent tube and so that polarities of adjacent magnets are different to each other.

The sixth aspect of the present invention is the thermal printer according to the first aspect, wherein the magnetic circuit comprises four magnets positioned at equal intervals along a peripheral surface of the fluorescent tube so that polarities of adjacent magnets are different to each other.

The seventh aspect of the present invention is the thermal printer according to the first aspect, wherein the magnetic circuit comprises a magnet shaped as a semicylinder, and more than half of an outer peripheral surface of the fluorescent tube is surrounded by a concave portion of the magnet.

The eighth aspect of the present invention is the thermal printer according to the first aspect, wherein the magnetic circuit comprises: a frame formed with a U shaped cross section from a ferromagnetic material and mounted so as to surround half a side surface of the hot cathode fluorescent lamp; and a pair of magnets positioned such that different polarities face each end of the frame and so as to sandwich one filament electrode of the hot cathode fluorescent lamp and a portion of the fluorescent tube.

The ninth aspect of the present invention is the thermal printer according to the first aspect, wherein the magnetic circuit comprises: a frame formed with a U shaped cross section from a ferromagnetic material and mounted so as to surround half a side surface of the hot cathode fluorescent lamp; and two pairs of magnets positioned such that different polarities face each end of the frame and so as to sandwich the filament electrodes at both ends of the hot cathode fluorescent lamp and a portion of the fluorescent tube.

The tenth aspect of the present invention is the thermal printer according to the eighth and ninth aspects, wherein a magnet used in the magnetic circuit is in a rectangular shape, a rectangular shape having one curved side, or a rectangular shape whose central portion has a different thickness to both end portions.

The eleventh aspect of the present invention is the thermal printer according to the first aspect, wherein the magnetic circuit comprises: a frame formed with a U shaped cross section from a ferromagnetic material and mounted so as to surround half a side surface of the hot cathode fluorescent lamp; and a pair of magnets mounted at both ends of the frame so as to sandwich the fluorescent tube; and two pairs of magnets positioned at both ends of the frame so as to sandwich the filament electrodes at both ends of the hot cathode fluorescent lamp and a portion of the fluorescent tube.

The twelfth aspect of the present invention is the thermal printer according to the eleventh aspect, wherein a magnet used in the magnetic circuit is in a rectangular shape, a rectangular shape having one side formed in a wave shape, or a rectangular shape whose thickness is formed in a wave shape.

The thirteenth aspect of the present invention is the thermal printer according to any one of the first to twelfth aspects, wherein a magnet used in the magnetic circuit is a ferrite magnet or a rare earth permanent magnet such as a samarium cobalt magnet.

The fourteenth aspect of the present invention is the thermal printer according to any of the first to twelfth aspects, wherein a magnet used in the magnetic circuit is an electromagnet formed from a soft porcelain material and a coil wound around the soft porcelain material.

The fifteenth aspect of the present invention is the thermal printer according to any of the first to fourteenth aspects, wherein the hot cathode fluorescent lamp is provided with a cooling fan at each end of the fluorescent tube for cooling the fluorescent tube.

The sixteenth aspect of the present invention is the thermal printer according to the fifteenth aspect, wherein the number of rotations of the cooling fan is controlled based on a surface temperature and illumination intensity of the fluorescent tube such that the illumination intensity is at maximum.

The seventeenth aspect of the present invention is a thermal printer comprising: moving device which moves thermal recording paper that is provided with color forming layers for performing color formation in a plurality of different colors in a first direction and in a second direction that is opposite to the first direction while the thermal recording paper is in a state of contact with a thermal head; first light fixing device provided at one side of the thermal head for fixing a first color; and second light fixing device provided at another side of the thermal head for fixing a second color, wherein the first and second fixing device comprise: a hot cathode fluorescent lamp formed from: a fluorescent tube that has a fluorescent coating applied to an inside surface of a glass tube and inside which are sealed mercury and noble gases, filament electrodes provided at both ends of the fluorescent tube, and lead wires that supply power to the filament electrodes; and a magnetic circuit that is provided on a side surface of the fluorescent tube and that generates a magnetic field that acts on current that flows through the fluorescent tube when power is fed to the filament electrodes.

According to the seventeenth aspect of the present invention, because there is no need to perform an operation to return the photosensitive material each time the printing of one color is completed, the effect is obtained that the time required to perform the printing operation can be shortened. In addition, according to the nineteenth aspect of the present invention, the effect is obtained that it is possible for the color formation of each color to be carried out at a predetermined position without there being any misalignment in the printing position.

The eighteenth aspect of the present invention is the thermal printer according to the seventeenth aspect, wherein the moving device is formed from a first pinch roller and a first feed roller provided at one adjacent side portion of the thermal head, a second pinch roller and a second feed roller provided at another adjacent side portion of the thermal head, and a pulse motor for driving the first and second feed rollers.

The nineteenth aspect of the present invention is the thermal printer according to the eighteenth aspect, the thermal printer further comprising: a first sensor provided in the vicinity of the first pinch roller and first feed roller for detecting a leading edge of the thermal recording paper; a second sensor provided in the vicinity of the second pinch roller and second feed roller for detecting a leading edge of the thermal recording paper; and printing start position determining device which supplies the pulse motor with a pulse number that is in accordance with a distance that a printing start position of the thermal recording paper is to be moved in order to be directly below the thermal head, based on results of detections by the first sensor and second sensor.

The twentieth aspect of the present invention is the thermal printer according to the thirteenth or nineteenth aspects, wherein there is provided a shutter for shutting off light from the first light fixing device at a point when fixing of the first color is completed.

The twenty first aspect of the present invention is a method of designing a hot cathode fluorescent tube that has a magnet and is structured such that a magnetic filed generated by the magnet acts on an electron flow so as to increase an illumination intensity, the method comprising: (a) a first step in which an empirical formula for representing a relationship between illumination intensity and magnetic energy density is derived from measurement values of illumination intensity and magnetic flux density inside the hot cathode fluorescent tube; (b) a second step in which initial values for a shape of the magnet are set; (c) a third step in which a model of the hot cathode fluorescent tube is created to be used for applying a finite element method; (d) a fourth step in which an evaluation coefficient that serves as an index for evaluating the shape of the magnet is derived using the empirical formula; and (e) a fifth step in which the finite element method is applied to the hot cathode fluorescent tube model and the shape of the magnet that was set to the initial values is optimized using the evaluation coefficient.

According to the twenty first aspect of the present invention, because the shape of the magnets is decided by numerical analysis, it is possible to optimize the magnet shape without having to rely on experience or intuition and the make the illumination intensity uniform over the entire effective length of the fluorescent tube.

The twenty second aspect of the present invention is the method of designing a hot cathode fluorescent tube according to the twenty first aspect, wherein, in the first step the magnetic flux density inside the hot cathode fluorescent tube and the illumination intensity when the magnet is mounted inside the hot cathode fluorescent tube are measured and the empirical formula is determined from the relationship between the illumination intensity and the magnetic flux density.

The twenty third aspect of the present invention is the method of designing a hot cathode fluorescent tube according to the twenty first or twenty second aspects, wherein, in the fourth step $\chi=(E_{obj}/E_{av}-1)^2$ is used as the evaluation coefficient when $E_{obj}$ is taken as the illumination intensity when the magnet is not mounted and $E_{av}$ is taken as the average illumination intensity when the magnet is mounted.

BRIEF DESCRIPTION OF THE DRAWINGS

FIGS. 23A and 23B are perspective views of a magnet.

FIG. 24 is a graph for showing the effects of the fixing lamp 7*h*.

FIGS. 25A and 25B are cross sectional views showing the ninth embodiment of the present invention.

FIGS. 26A and 26B are perspective views of a magnet.

FIG. 27 is a graph for showing the effects of the fixing lamp 7*i*.

FIGS. 28A and 28B are cross sectional views showing the tenth embodiment of the present invention.

DESCRIPTION OF THE PREFERRED EMBODIMENTS

Figure 1:
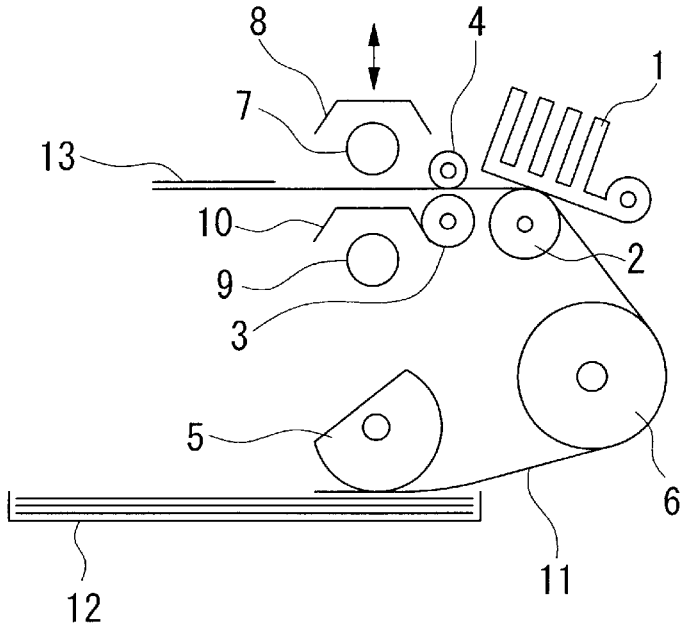
FIG. 1 is a schematic structural view showing the structure of the first embodiment of the present invention.

The embodiments of the present invention will now be described with reference made to the drawings. FIG. 1 is a schematic structural view showing the structure of a thermal printer according to the first embodiment of the present invention. In the initial state before the printing operation is carried out, the thermal head 1 and pinch roller 4 are in a raised position separated respectively from a platen roller 2 and a feed roller 3. In this state, if the power is turned on and the printing operation is started, TA paper 11 kept in the TA paper cassette 12 is fed toward a guide roller 6 by a feed out roller 5.

Next, the TA paper 11 passes between the thermal head 1 and the platen roller 2 guided by the guide roller 6 and is transported to a point between the feed roller 3 and the pinch roller 4. The thermal head 1 and the pinch roller 4 that had been lifted to raised positions are lowered, and the TA paper 11 is press contacted against the platen roller 2 and the feed roller 3 by the thermal head 1 and the pinch roller 4. Next, the feed roller 3 rotates in a positive direction (i.e. in an anticlockwise direction) at a fixed speed and the thermal head 1 performs thermal color formation printing of the Y color (yellow).

When the leading portion of the Y color printing begins to appear at the left side of the feed roller 3, the Y color fixing lamp 7 is turned on and light is irradiated onto the TA paper 11. When the thermal color formation printing of the Y color is finished, the thermal head 1 is lifted up and, at the point when the rear end portion of the TA paper 11 arrives at the feed roller 3, a shutter 13 is gradually moved towards the right, in a manner in which the light fixing amount remains constant, and ultimately covers the entire surface of the TA paper 11. Next, when the Y color fixing lamp 7 is turned off, the shutter 13 is moved towards the left and is returned to its original position.

Next, the feed roller 3 is rotated in reverse (i.e. in a clockwise direction) and the TA paper 11 is fed in reverse until the leading portion of the TA paper 11 on which the printing has started arrives directly below the heat generating portion of the thermal head 1. The M (magenta) color fixing lamp 9 and the Y color fixing lamp 7 are then slid together towards the top. At this time, the M (magenta) color fixing lamp 9 is slid to a predetermined position for irradiating light.

Next, the thermal head 1 is lowered downwards so as to place the TA paper 11 in press contact against the platen roller 2 and start the printing of the M color. At the same time as the printing of the M color is started the feed roller 3 is rotated in the positive direction and transports the TA paper 11 towards the left. When the leading portion on which the M color has been printed arrives at the left side of the feed roller 3, the M color fixing lamp 9 is turned on and light is irradiated onto the TA paper 11 so as to perform the light fixing of the M color. Then, when the thermal color formation printing of the M color has ended, the thermal head 1 is lifted upwards.

Next, the feed roller 3 is rotated in reverse (i.e. in the clockwise direction) and the TA paper 11 is fed in reverse until the leading portion of the TA paper 11 on which the printing has started arrives directly below the heat generating portion of the thermal head 1. The thermal head 1 is then lowered and the TA paper 11 is placed in press contact against the platen roller 2 so as to print the C (cyan) color. When the printing is completed, the TA paper 11 is ejected.

Figure 2:
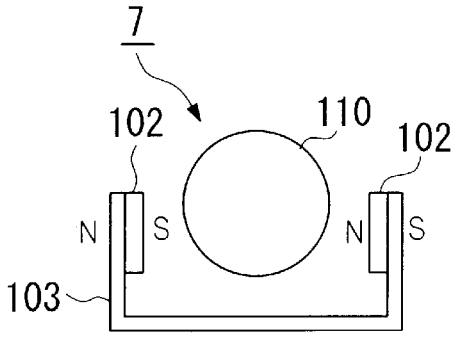
FIG. 2 is a cross sectional view showing the structure of the fixing lamp 7 in the first embodiment.

Next, the Y color fixing lamp 7 used in the above structure will be described. FIG. 2 is a cross sectional view showing the structure of the fixing lamp 7. This fixing lamp 7 is formed from a hot cathode fluorescent lamp. A fluorescent coating material is adhered to the entire inside surface of the glass tube of this lamp and a pair of electrodes are provided at both ends of the glass tube. Inside the tube are sealed noble gases such as argon gas and mercury. In this fixing lamp 7, when filaments that are provided at both ends of the fluorescent tube 110 are heated by being energized from lead wires embedded in the caps, thermoelectrons are released from the filaments. The thermoelectrons collide with the mercury vapor vaporized inside the fluorescent tube and excite the mercury vapor. The excited mercury vapor releases energy in the form of ultraviolet light as it returns to a ground state. At this time, ultraviolet having a generated wavelength of 245 nm and 185 nm further excites the fluorescent material coated on the inside surface of the fluorescent tube and light in the ultraviolet and visible ranges, for example, light having a wavelength of 365 nm, 420 nm, and 450 nm is emitted.

Further, in FIG. 2, the symbol 103 denotes a frame formed with a U shaped cross section from a ferromagnetic material. The symbol 102 denotes a pair of magnets placed at both ends of the frame 103 and positioned such that the magnetic poles that face each other are different. A magnetic circuit is formed by the frame 103 and the pair of magnets 102. Permanent magnets or electromagnets can be used as the magnets 102. In the examples below the use of rare earth permanent magnets such as samarium cobalt magnets and the like is described. The magnetic circuit is mounted so as to surround the lower half of the side surface of the fluorescent tube 110 through the frame 103.

Figure 3:
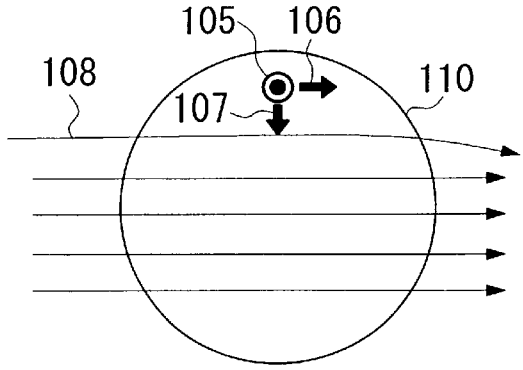
FIG. 3 is a view showing the operation of the fixing lamp 7 in FIG. 2.

FIG. 3 shows the magnetic flux distribution inside the fluorescent tube 110. A description will now be given while referring to FIG. 3 of the principle of increasing the illumination intensity of the fixing lamp 7 that is formed with the structure shown in FIG. 2. High frequency voltage is applied to both ends of the fluorescent tube 110 shown in FIG. 3 inside which mercury vapor has been sealed such that the polarities are cyclically changed. When the direction of the flow of the electric current 105 of the fluorescent tube 110 is towards this side at right angles to the surface of the drawing, the direction of the electron flow is in the opposite direction, namely, the flow is away from this side towards the far side. When the magnetic field 106 is acting at right angles to the current 105, a force 107 acts on the current 105 (this is known as Fleming's left hand rule). This results in the electrons performing a magnetron operation that, compared with when the magnetic field 108 created by the permanent magnets is not present, has a markedly longer operation track and causes an increase in the acceleration distance and an increase in the chance of a collision with the mercury vapor. As a result, the light generating efficiency of the fixing lamp 7 is increased.

Figure 4:
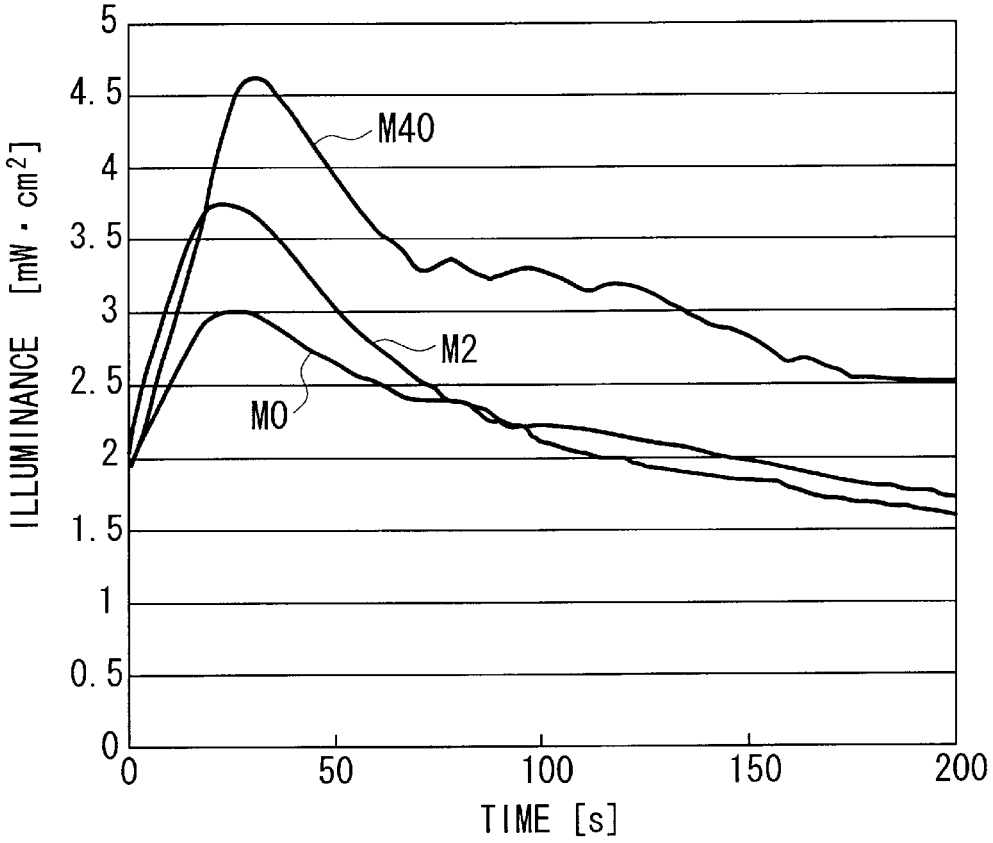
FIG. 4 is a graph showing an effect of the fixing lamp 7 shown in FIG. 2.
Figure 5A:
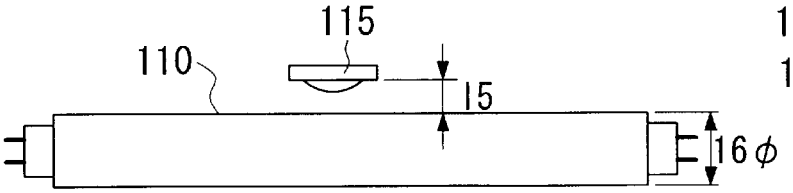
FIGS. 5A and 5B are views showing a system for measuring illumination intensity.
Figure 5B:
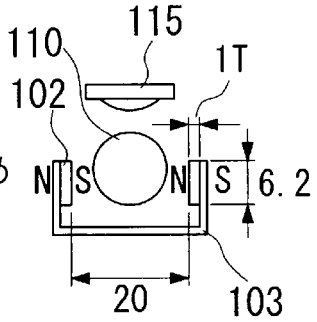
Figure 7:
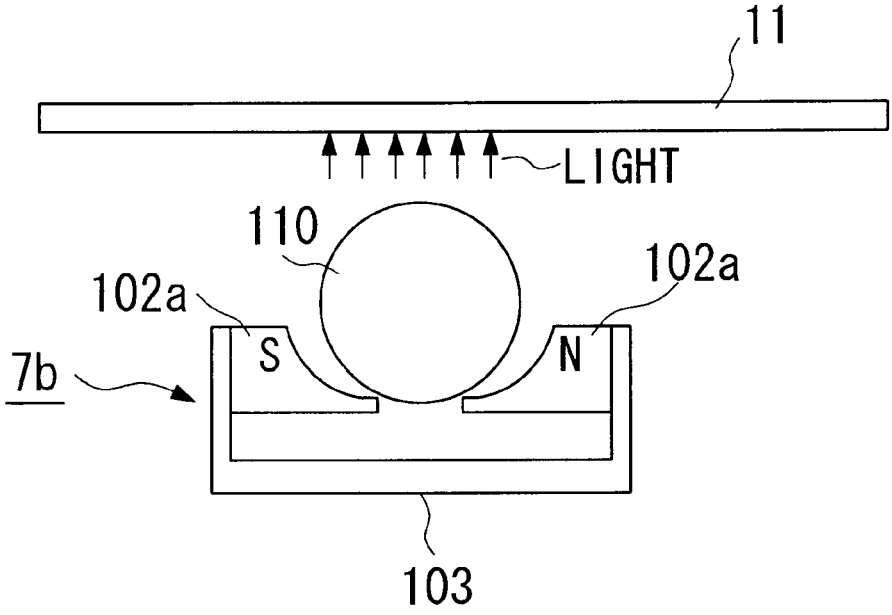
FIG. 7 is a cross sectional view showing the third embodiment of the present invention.

The changes over time in the illumination intensity when a hot cathode fluorescent lamp having the structure shown in FIG. 2 is turned on and when a conventional hot cathode fluorescent lamp is turned are shown in FIG. 4. The first curved line M40 shows the changes in the illumination intensity of the fixing lamp 7 when 20 pairs of permanent magnets are mounted. The second curved line M2 shows the changes in the illumination intensity of the fixing lamp 7 when one pair of permanent magnets is mounted. The third curved line M0 shows the changes in the illumination intensity of a conventional hot cathode fluorescent tube. As is shown in FIG. 7, the peak illumination intensity increases as the number of permanent magnets used is increased and the magnetic flux intensity increased. It is thus possible to raise the illumination intensity by 50% or more compared with the illumination intensity of a conventional hot cathode fluorescent lamp. If the relationship between the number of permanent magnets used and the increase in the illumination intensity is looked at, it will be seen that the illumination intensity rises in proportion to the magnetic field intensity up to a certain point, however, after that point saturation occurs. FIGS. 5A and 5B show the measurement system used for measuring the above illumination intensity. The symbol 115 in FIGS. 5A and 5B indicates an illumination intensity sensor that is positioned at a distance of 15 mm from the fluorescent tube 110. Samarium cobalt magnets are used for the permanent magnets 102 and these are mounted at both ends of a frame 103 made from zinc galvanized steel plate.

Figure 6:
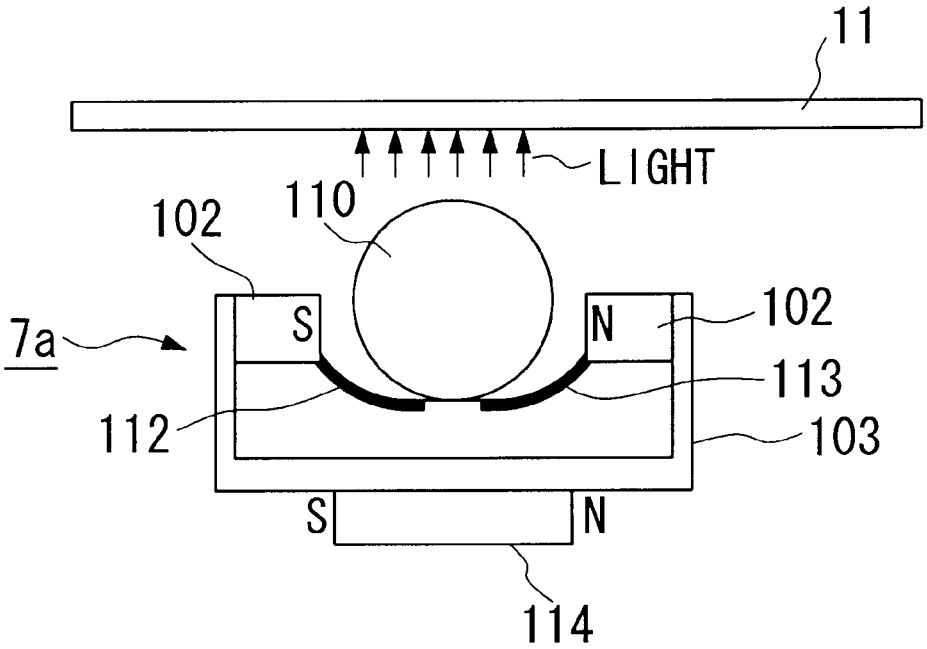
FIG. 6 is a cross sectional view showing the second embodiment of the present invention.

Next, a description will be given of the second embodiment of the present invention. FIG. 6 is a cross sectional view showing the structure of the fixing lamp 7*a* according to the second embodiment of the present invention. In the fixing lamp 7*a* shown in this drawing, reflective plates 112 and 113 are formed in an integral structure between the end portion of the magnets 102 and the back portion of the fluorescent tube 110 (i.e. on the opposite side from the TA paper 11). These reflective plates 112 and 113 are formed from aluminum or from a plastic film on the surface of which is coated by a vapor deposition method a reflective film formed from aluminum or the like. The symbol 114 indicates a permanent magnet that is attached to the frame 103 and that further intensifies the magnetic flux from the magnets 102. Note that it is not necessary to provide the magnet 114.

Next, a description will be given of the third embodiment of the present invention. FIG. 7 is a cross sectional view showing the structure of the fixing lamp 7*b* according to the third embodiment of the present invention. In the fixing lamp 7*b* shown in this drawing, the shape of the magnet 102 in FIG. 2 has been altered. Namely, one surface of each magnet 102*a* that faces the fluorescent tube 110 has been curved in a shape that corresponds substantially to the surface of the fluorescent tube 110. This surface is smoothed and vapor deposited with aluminum to also fulfill the function of a reflective plate.

Figure 8A:
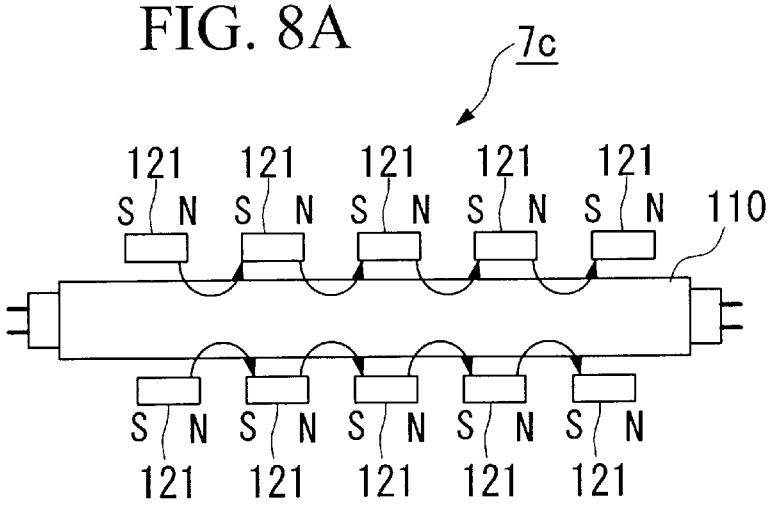
FIGS. 8A and 8B are cross sectional views showing the fourth embodiment of the present invention.
Figure 8B:
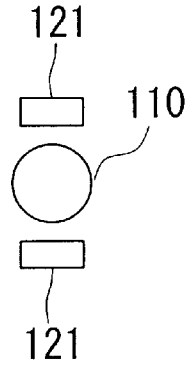

Next, a description will be given of the fourth embodiment of the present invention. FIGS. 8A and 8B show schematic cross sections of the fixing lamp 7*c* according to the fourth embodiment. As is shown in these drawings, a plurality of magnetic circuits are provided at equal intervals along the side surface of the fluorescent tube 110. The plurality of magnetic circuits are positioned so that the polarities of adjacent magnets are different to each other. FIG. 8A shows an example of the provision of magnetic circuits. When the magnetic circuits are provided in this way, the magnetic flux is generated in the directions indicated by the arrows in the drawing and acts on the current flowing through the fluorescent tube 110 when the power is turned on thus increasing the illumination intensity.

Figure 9A:
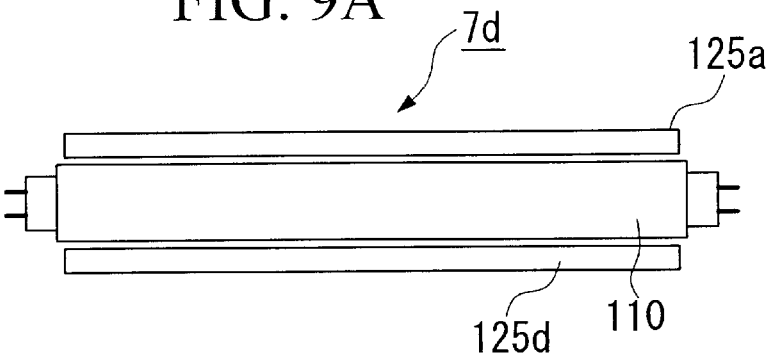
FIGS. 9A and 9B are cross sectional views showing the fifth embodiment of the present invention.
Figure 9B:
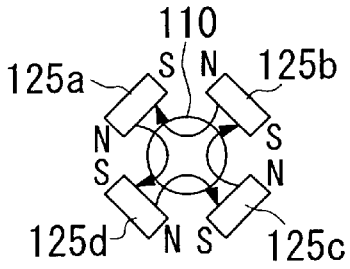

Next, a description will be given of the fifth embodiment of the present invention. FIGS. 9A and 9B show schematic cross sections of the fixing lamp 7*d* according to the fifth embodiment. As is shown in these drawings, four magnets 125*a* to 125*d* are provided at equal intervals along the outer peripheral surface of the fluorescent tube 110. The magnets 125*a* to 125*d* are positioned so that the polarities of adjacent magnets are different to each other. When the magnetic circuits are provided in this way, a magnetic field is generated in the directions indicated by the arrows and acts on the current flowing through the fluorescent tube 110 when the power is turned on thus increasing the illumination intensity.

Figure 10A:
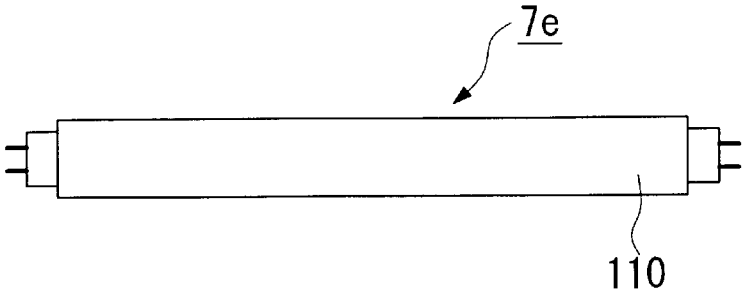
FIGS. 10A and 10B are cross sectional views showing the sixth embodiment of the present invention.
Figure 10B:
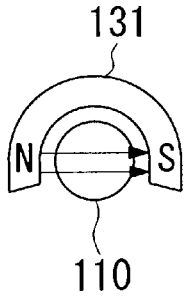

Next, a description will be given of the sixth embodiment of the present invention. FIGS. 10A and 10B show schematic cross sections of the fixing lamp 7*e* according to the sixth embodiment. As is shown in these drawings, a semi cylindrical permanent magnet 131 is used for the magnetic circuit. The fluorescent tube 110 is mounted so that the concave portion of the semi cylindrical permanent magnet 131 surrounds more than half of the outer peripheral surface of the fluorescent tube 110. When the magnetic circuit is provided in this way, a magnetic field is generated in the directions indicated by the arrows and acts on the current flowing through the fluorescent tube 110 thus increasing the illumination intensity.

Figure 11:
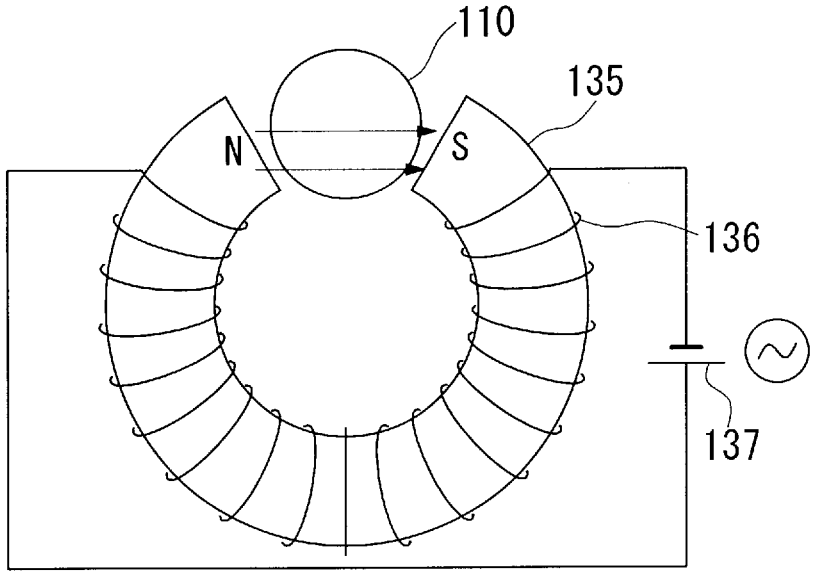
FIG. 11 is a view of the structure when an electromagnet is used in FIGS. 10A and 10B.

Note that in the above described fixing lamp 7*e*, a permanent magnet is used, however, even when an electromagnet is used, it can be structured in the same way. FIG. 11 is a view showing the structure when an electromagnet is used. The electromagnet is formed by winding a coil 136 around a soft porcelain material 135 and supplying electricity from a power source 137.

Figure 12A:
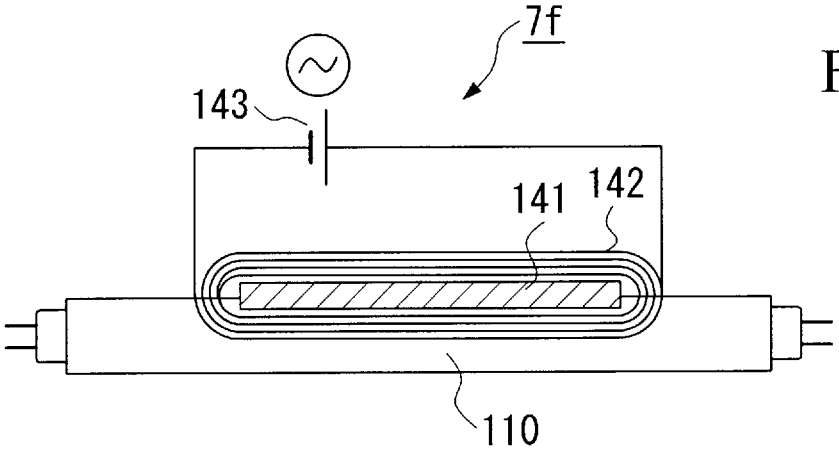
FIGS. 12A and 12B are cross sectional views showing the seventh embodiment of the present invention.
Figure 12B:
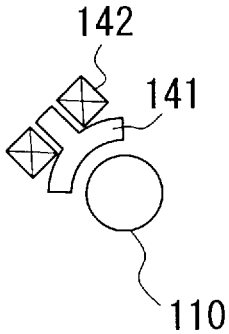

Next, a description will be given of the seventh embodiment of the present invention. FIGS. 12A and 12B show schematic cross sections of the fixing lamp 7*f* according to the seventh embodiment. As is shown in the drawings, the feature of the present embodiment is that an electromagnet formed from an iron core 141 formed with a T shaped cross section and a coil 142 wound around the iron core 141 is mounted at the outer side of the fluorescent tube 110. Electricity is supplied from a power source 143 to the coil 142 and magnetic flux is generated from the iron core 141. By generating magnetic flux from the T shaped iron core 141, it is possible for the magnetic field from a single electromagnet to act efficiently on the current flowing through the inside of the fluorescent tube 110 thus increasing the intensity of the illumination from the hot cathode fluorescent lamp.

Figure 20:
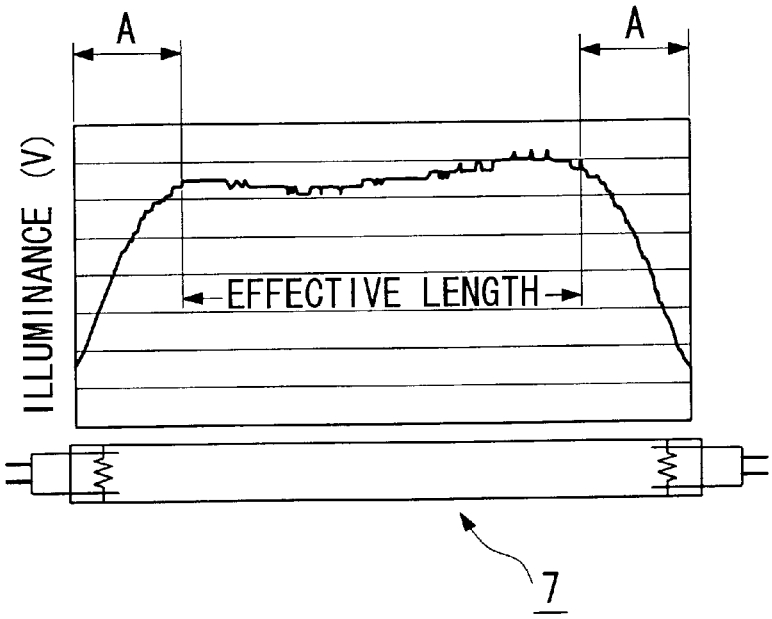
FIG. 20 is a graph showing the distribution of the illumination intensity of a conventional fixing lamp.
Figure 21A:
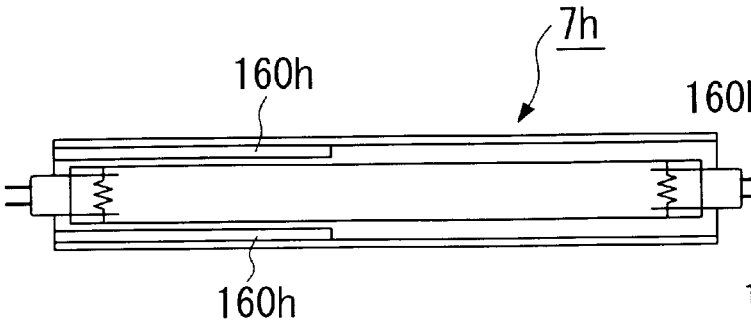
FIGS. 21A and 21B are cross sectional views showing the eighth embodiment of the present invention.
Figure 21B:
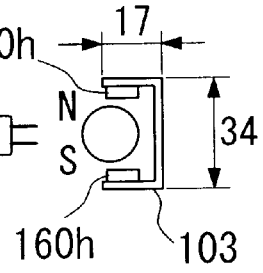

Next, a description will be given of the eighth embodiment of the present invention. In the above described second to seventh embodiments, various modifications were made to the structure of the fixing lamp 7 of the first embodiment so as to intensify the illumination intensity of the fixing lamp 7. In contrast, as is shown in FIG. 20, the distribution of the illumination intensity in the longitudinal direction of the fixing lamp 7 is not uniform and at both ends of the fluorescent tube 110, i.e. at the portions marked A, the illumination intensity is reduced. In a hot cathode fluorescent tube used in a thermal printer, it is desirable if a uniform illumination intensity is obtained and if the effective length of the fluorescent tube that can actually be used is made as long as possible. FIGS. 21A and 21B show cross sections of the fixing lamp 7*h* according to the eighth embodiment. As is shown in these drawings, a magnetic circuit is formed from a frame 103 for mounting the magnets, and magnets 160*h* that are mounted such that the magnetic poles that face each other are different to each other. This magnetic circuit is provided in one filament electrode side of the fluorescent tube 110.

Figure 22:
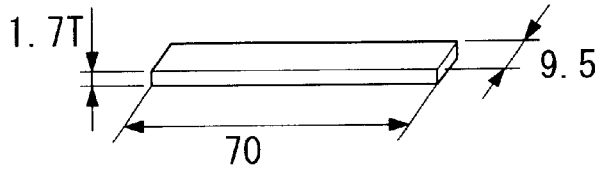
FIG. 22 is a perspective view of a magnet.

FIG. 22 shows an example of a rectangular magnet having a maximum energy product of 33 MGOe used for the magnets 160*h*. FIG. 24 is a graph showing the effect when the magnet shown in FIG. 22 is used. The curved line NT in FIG. 24 shows the illumination intensity distribution when the magnets 160*h* are not mounted, while the curved line Mh shows the illumination intensity distribution when the magnets 160*h* are mounted. It is possible to improve the effective length by mounting the magnets 160*h*. In order to improve the effective length even further, magnets having the shapes shown in FIGS. 23A and 23B are used. The magnet shown in FIG. 23A has a constant thickness and a shape in which one side of the rectangle is convexly curved so that the illumination intensity distribution is made flat. In contrast, the magnet shown in FIG. 23B has a rectangular shape and the thickness of both ends thereof are decreased in comparison with the center part so as to achieve a flattening of the illumination intensity distribution.

Next, a description will be given of the ninth embodiment of the present invention. FIGS. 25A and 25B show cross sections of the fixing lamp 7*i* according to the ninth embodiment. As is shown in these drawings, two magnetic circuits are formed from a frame 103, and two pairs of magnets 160*i* that are mounted such that the magnetic poles thereof that face each other are different to each other. The two magnetic circuits are arranged so that one is provided in the filament electrode side at each end of the fluorescent tube 110. FIG. 27 is a graph showing the effect when rectangular magnets are used as the magnets 160*i*. The curved line NT in FIG. 27 shows the illumination intensity distribution when the magnets 160*i* are not mounted, while the curved line Mi shows the illumination intensity distribution when the magnets 160*i* are mounted. The effective length is improved by mounting the magnets 160*i*.

As is shown by the illumination intensity distribution Mi, it is possible to improve the effective length through the use of the rectangular magnets 160*i*, however, because a peak is created in the illumination intensity distribution, in order to improve the effective length and flatness even more, magnets having the shapes shown in FIGS. 26A or 26B are used. The magnet shown in FIG. 26A is shaped with one side of the magnet curved to become gradually narrower so that the illumination intensity in the vicinity of the filament electrodes is strengthened, the increase in the illumination intensity is adjusted by gradually weakening the magnetic force, and the flatness of the illumination intensity distribution is improved. Moreover, the magnet shown in FIG. 26B achieves flatness in the illumination intensity distribution and adjusts the increase in the illumination intensity by changing the magnetic force by altering the thickness of the magnet to form a wedge shape.

Next, a description will be given of the tenth embodiment of the present invention. FIGS. 28A and 28B show cross sections of the fixing lamp 7*j* according to the tenth embodiment. As is shown in these drawings, magnetic circuits are formed from a frame 103 as well as a pair of magnets 160*j* and two pairs of magnets 161*j* that are mounted such that the facing magnetic poles thereof are different to each other. The magnets 160*j* are long enough to act on the entire fluorescent tube 110 and increase the illumination intensity of the entire hot cathode fluorescent lamp. The two magnetic circuits formed using the magnets 161*j* are arranged so that one is provided in the filament electrode side at each end of the fluorescent tube 110 so as to raise the illumination intensity in the vicinity of the filament electrodes and achieve flatness in the illumination intensity distribution.

Figure 29A:
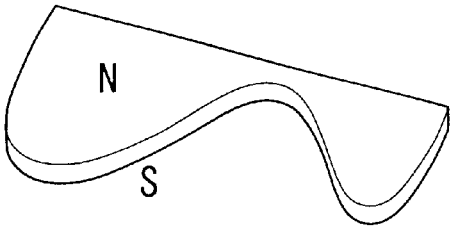
FIGS. 29A and 29B are perspective views of a magnet.
Figure 29B:
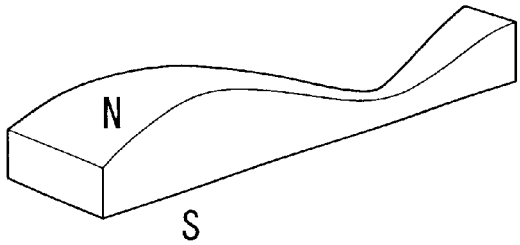
Figure 30:
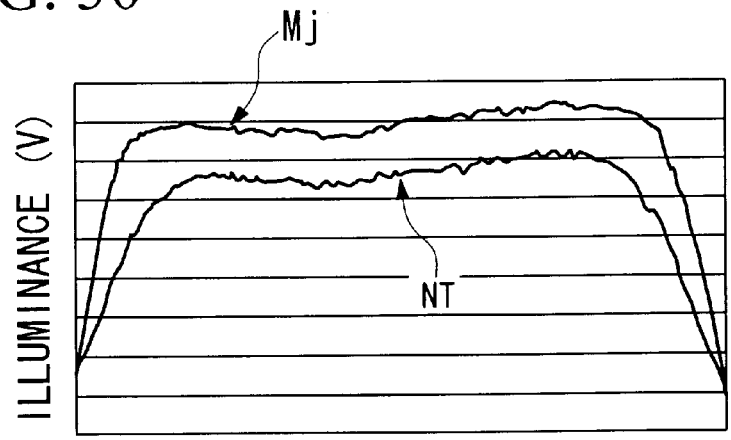
FIG. 30 is a graph for showing the effects of the fixing lamp 7*j*.
Figure 31:
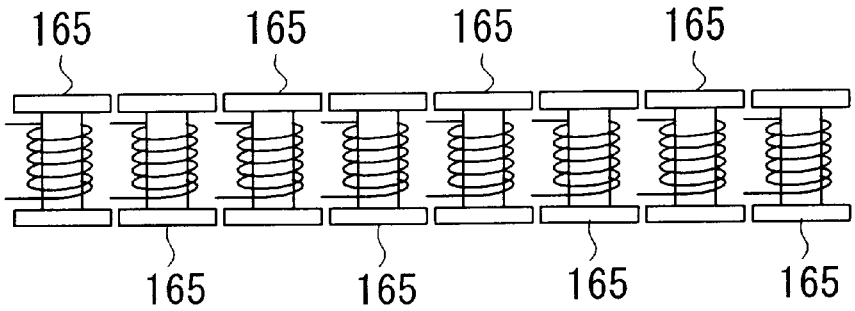
FIG. 31 is a view showing the structure when an electromagnet is used.

FIG. 30 is a graph showing the effect when rectangular magnets are used for the magnets 160*j* and 161*j*. The curved line NT in FIG. 30 shows the illumination intensity distribution when the magnets 160*j* and 161*j* are not mounted, while the curved line Mh shows the illumination intensity distribution when the magnets 160*j* and 161*j* are mounted. It is possible to improve the illumination intensity and effective length by mounting the magnets 160*j* and 161*j*. In order to achieve even more uniformity in the illumination intensity distribution, magnets having the shapes shown in FIGS. 29A and 29B are used for the magnets 161*j*. The magnet shown in FIG. 29A has a shape in which one side is formed in a wave shape so that the width of the magnet is made to vary thereby adjusting the magnetic force and achieving a flattening in the illumination intensity distribution by changing the degree to which the illumination intensity is increased. In the magnet shown in FIG. 29B the thickness is changed in a wave shape so as to adjust the magnetic force and achieve a flattening in the illumination intensity. FIG. 31 shows an example of when the above described magnets 160*h* to 160*j* and 161*j* are formed from electromagnets 165.

Figure 13:
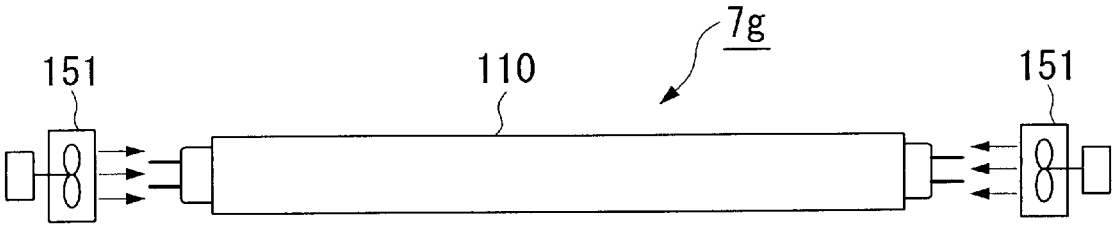
FIG. 13 is a cross sectional view showing the eleventh embodiment of the present invention.
Figure 14:
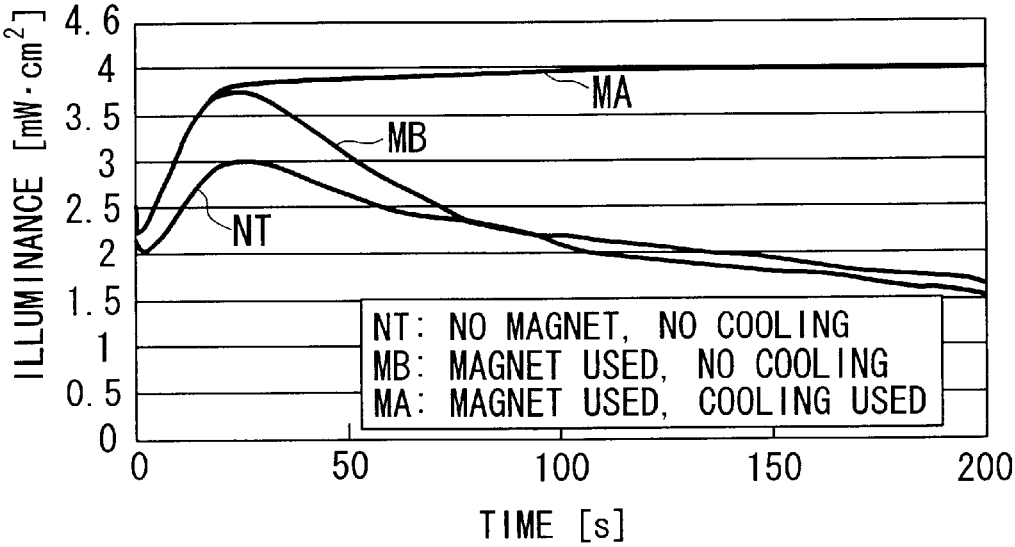
FIG. 14 is a graph showing changes in the illumination intensity of the hot cathode fluorescent lamp according to the eleventh embodiment.

Next, a description will be given of the eleventh embodiment of the present invention. FIG. 13 shows the structure of the fixing lamp 7*g* according to the eleventh embodiment. As is shown in FIG. 13, a cooling fan 151 is mounted at each end of the fluorescent tube 110. As a result of the surface of the fluorescent tube 110 being cooled by the cooling fans 151, an intensified illumination intensity is able to be maintained for a long period of time. The rotation of the cooling fan 151 is controlled, based on values measured for the illumination intensity of the fixing lamp 7*g* and the surface temperature of the fluorescent tube, such that the illumination intensity is at the maximum. FIG. 14 is a graph showing the changes in the illumination intensity over time when a conventional hot cathode fluorescent lamp is turned on and when the fixing lamp having the structure shown in FIG. 13 is turned on. The first curved line MA shows the changes in the illumination intensity when the fixing lamp 7 in which a magnetic circuit is provided (see FIG. 1) is cooled using the cooling fans 151 provided at each end thereof.

The second curved line MB shows the changes in the illumination intensity when the fixing lamp 7 in which an magnetic circuit is provided is not cooled, while the third curved line NT shows the changes in the illumination intensity when a conventional hot cathode fluorescent lamp with no cooling is used. As is shown by the curved lines MB and NT, when the fluorescent tube 110 is not cooled, the illumination intensity decreases over time from the peak illumination intensity. In contrast, the curved line MA shows that it is possible to maintain the peak illumination intensity over a long period of time by cooling the fluorescent tube 110 using the cooling fans 151.

Next, a description will be given of the twelfth and thirteenth embodiments of the present invention. In the above described second to eleventh embodiments various modifications were made to the structure fixing lamp according to the first embodiment, however, in the embodiments described below, modifications are made to the rest of the structure apart from the fixing lamp 7.

Figure 15:
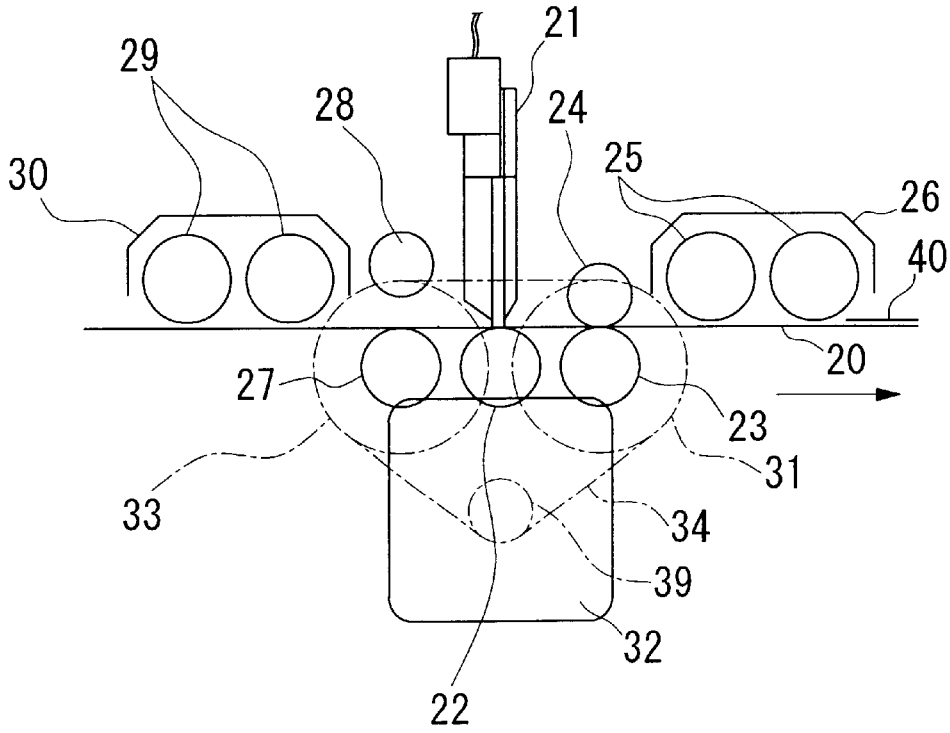
FIG. 15 is a cross sectional view showing the twelfth embodiment of the present invention.
Figure 17:
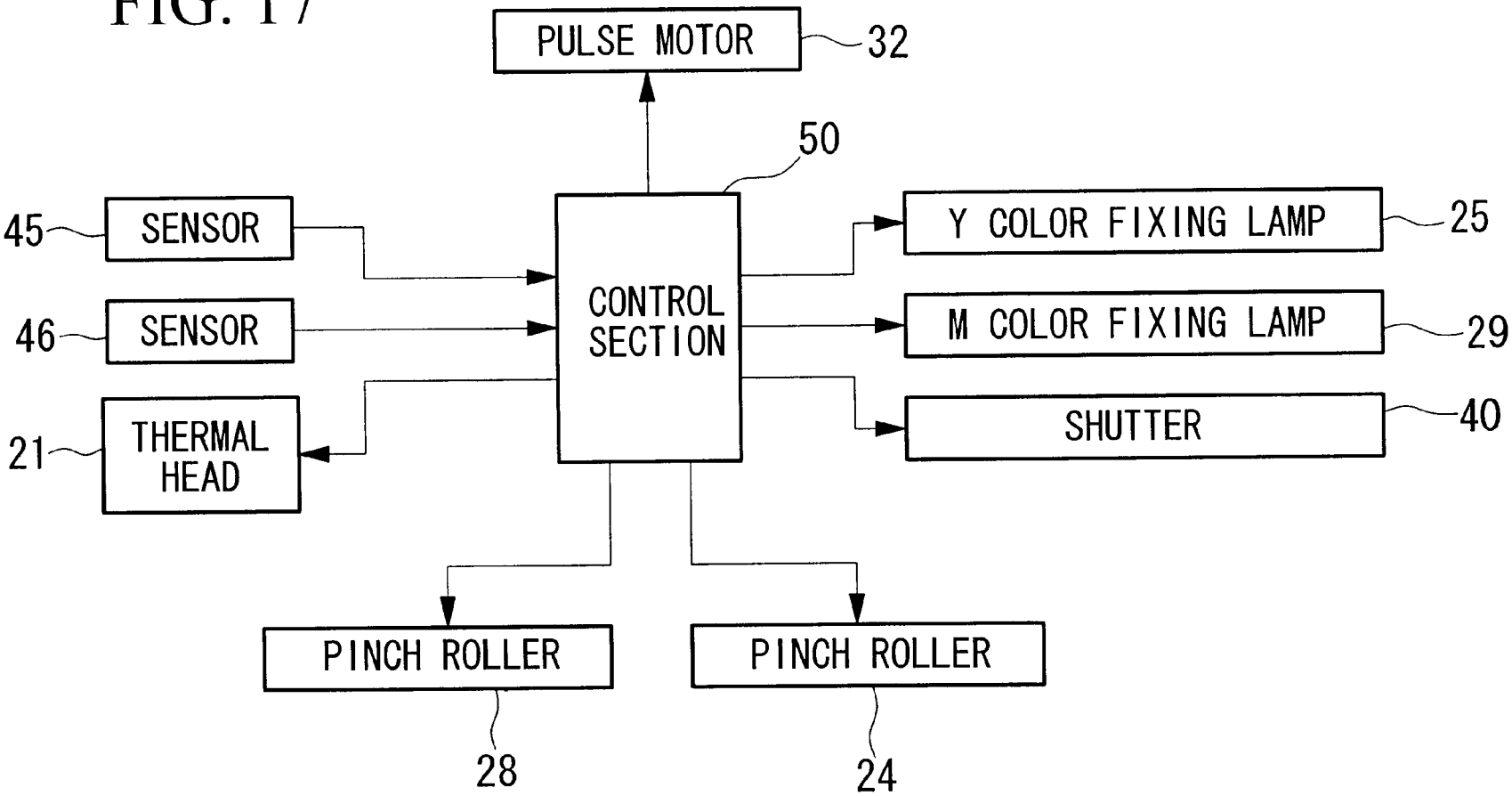
FIG. 17 is a block diagram showing the structure of an electrical circuit in the twelfth embodiment.

FIG. 15 is a block diagram showing the twelfth embodiment of the present invention. FIG. 17 is a block diagram showing the connections of a control section 50. In these diagrams the symbol 20 indicates TA paper comprising a substrate such as paper or synthetic paper on which has been coated a color forming agent and a developer. The symbol 21 indicates a thermal head having a heat generating portion on the surface thereof that contacts the platen roller 22. The thermal head then sandwiches the TA paper between the heat generating portion and a platen roller 22 and the heat generating portion performs a heating process on the TA paper 20 so as to perform thermal color development on the TA paper 20. The operation of this heating process by the thermal head 21 is based on control signals output from the control section 50 and the operation to print the TA paper 20 is carried out in the direction in which the TA paper 20 is transported.

A feed roller 23 and a pinch roller 24 sandwich the TA paper 20, and the feed roller 23 is rotated when it receives rotation force transmitted from a pulley 31 so as to transport the TA paper 20. The symbol 25 indicates a Y (yellow) color fixing lamp for irradiating light for fixing Y color on the TA paper 20. A fixing lamp having the same structure as one of the fixing lamps 7 and 7*a* to 7*g* of the above described first to eighth embodiments is used for the fixing lamp 25. The symbol 26 indicates a reflective plate for raising the light irradiation efficiency by reflecting light irradiated from the Y color fixing lamp 25 onto the TA paper 20.

A feed roller 27 and a pinch roller 28 sandwich the TA paper 20, and the feed roller 27 is rotated when it receives rotation force transmitted from a pulley 33 so as to transport the TA paper 20. The symbol 29 indicates an M (magenta) color fixing lamp for fixing M color on the TA paper 20 after the printing of the M color has been carried out. A fixing lamp having the same structure as one of the fixing lamps 7 and 7*a* to 7*g* of the above described first to eighth embodiments is used for the fixing lamp 29. The symbol 30 indicates a reflective plate for raising the light irradiation efficiency by reflecting light irradiated from the M color fixing lamp 29 onto the TA paper 20.

A pulse motor 32 rotates at a constant angle of rotation each time in accordance with the number of pulses output from the control section 50. A pulley 39 is fixed to the rotation shaft of this pulse motor 32 and the pulley 39 is linked to the pulley 31 and the pulley 33 via a belt 34. As a result, the feed roller 23 and the feed roller 27 can be driven to rotate.

A sensor 45 is formed from a light emitting diode and a light receiving diode. The light receiving diode receives light irradiated from the light emitting diode. When the TA paper 20 passes between the pinch roller 24 and the feed roller 23, the light irradiated from the light emitting diode to the light receiving diode is cut off. Consequently, it is possible to detect that the TA paper 20 has arrived between the pinch roller 24 and the feed roller 23. The result of this detection is then output to the control section 50.

In the same way, a sensor 46 formed from a light emitting diode and a light receiving diode is provided between the pinch roller 28 and the feed roller 27. The sensor 46 detects that the TA paper 20 has arrived between the pinch roller 28 and the feed roller 27 and outputs the detection result to the control section 50.

Next, the control section 50 will be described. As is shown in FIG. 17, the control section 50 is connected to each section and performs the control of the raising and lowering operations of the pinch roller 24 and the pinch roller 28, the heating process of the thermal head 21, the rotation operation of the pulse motor 32 based on detection signals output from the sensor 45 and the sensor 46, the turning on and off of the Y color fixing lamp 25 and the M color fixing lamp 29, the opening and closing operations of the shutter 40, and the like (described in detail below).

Next, a description will be given of the device having the above described structure. Firstly, in FIG. 15, the thermal head 21 is in contact with the platen roller 22 and the pinch roller 24 is in contact with the feed roller 23, however, in the initial state before printing is started, the thermal head 21 and the pinch roller 24 are lifted up and separated from the platen roller 22 and the feed roller 23 respectively.

In this state, when printing is begun, the TA paper 20 is transported in the direction indicated by the arrow from the left hand side in FIG. 15 by a paper supply roller and passes between the feed roller 27 and the pinch roller 28 and between the thermal head 21 and the platen roller 22. Next, when the portion of the TA paper that is at the front in the direction of travel (referred to below as the distal end portion) arrives between the feed roller 23 and the pinch roller 24, the fact that the TA paper 20 has arrived is detected by the sensor 45 and a detection signal is output to the control section 50.

When the control section 50 receives the detection signal from the sensor 45, the pinch roller 24 is lowered downwards and placed in press contact with the feed roller 23 thus nipping the TA paper 20. In addition, the thermal head 21 is also lowered downwards and placed in press contact with the platen roller 22 thus nipping the TA paper 20.

The control section 50 then outputs to the pulse motor 32 a pulse number that accords with the distance to travel from the distal end portion of the TA paper 20 to the printing start position. The pulse motor 32 rotates in accordance with the output pulse number thereby rotating the feed roller 32 via the belt 34 and pulley 31. The printing start position of the TA paper 20 is thus transported to a position directly below the thermal head 21.

Next, the control section 50 performs the control of the heating process operation for the Y (yellow) color in accordance with the image being printed. Subsequently, the control section 50 rotates the pulse motor 32 so as to rotate the feed roller 23 and thereby perform the printing operation while the TA paper 20 is being transported in the direction indicated by the arrow.

Next, after the control section 50 has output to the pulse motor 32 pulses in accordance with the distance the printed distal; end portion is to travel between the feed roller 23 and the pinch roller 24, the control section 50 turns on the Y color fixing lamp 25 and fixes the Y color on the TA paper 20. As a result, color formation of the Y color does not occur thereafter on the TA paper 20 even if heat is applied from the thermal head 21.

After the Y color printing operation has been completed, when the end portion on which the Y color has been printed is transported to the right side of the feed roller 23, the control section 50 stops the rotation of the pulse motor 32. The shutter 40 is then moved to the left at a uniform speed and covers the surface of the TA paper shutting off the light irradiated from the Y color fixing lamp 25 so that the Y color fixing amount on the surface of the TA paper 20 is made constant.

Figure 16:
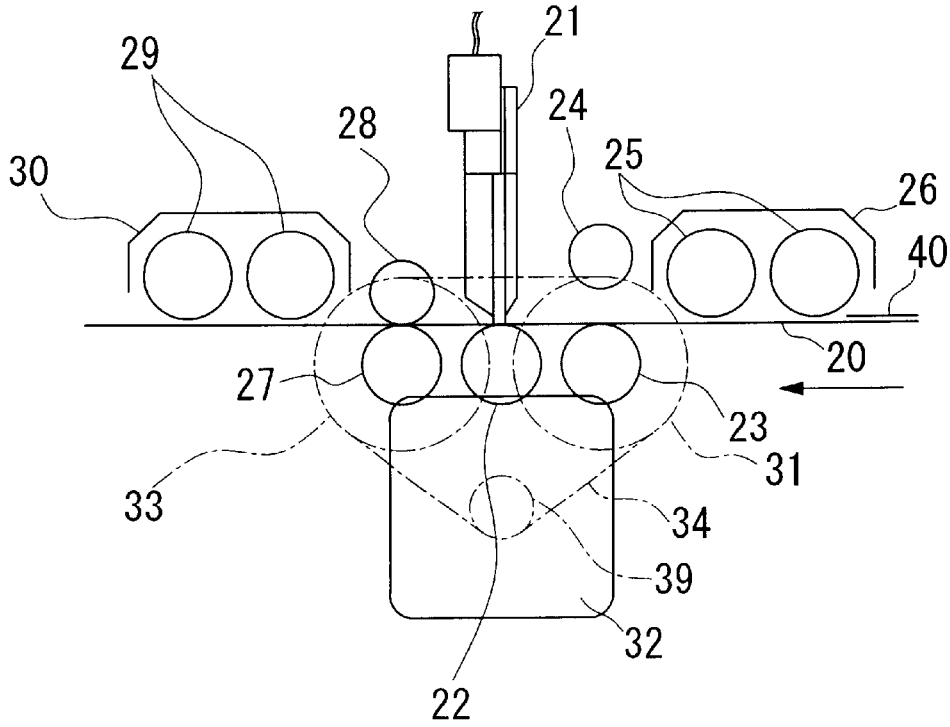
FIG. 16 is a view showing the operation of the device when printing magenta color in the twelfth embodiment.

Next, after the shutter 40 has covered the front surface of the TA paper 20, the control section 50 turns off the Y color fixing lamp 25 and moves the shutter 40 to a predetermined position at the right. Subsequently, the thermal head 21 is lifted up and the thermal head 21 and the platen roller 22 are separated. Next, the feed roller 23 is rotated in an anticlockwise direction so that the rear end portion of the TA paper 20 is transported in the direction indicated by the arrow in FIG. 16.

When the TA paper 20 is transported such that the distal end portion of the TA paper 20 is detected by the sensor 46, the control section 50 lowers the pinch roller 28 placing it in press contact with the feed roller 27. The thermal head 21 is also lowered placing it in press contact with the platen roller 22. In addition, the pinch roller 24 is lifted up, separating the pinch roller 24 from the feed roller 23. By then rotating the feed roller 27, the TA paper 20 is transported in the direction indicated by the arrow in FIG. 16.

The control section 50 then outputs to the pulse motor 32 a pulse number that accords with the distance to travel from the distal end portion of the TA paper 20 to the printing start position for the M (magenta) color. The pulse motor 32 rotates in accordance with the output pulse number thereby rotating the feed roller 27 via the belt 34 and pulley 33. The M color printing start position of the TA paper 20 is thus transported to a position directly below the thermal head 21.

Next, the control section 50 performs the control of the heating process operation for the M color in accordance with the image being printed. Subsequently, the control section 50 rotates the pulse motor 32 so as to rotate the feed roller 27 and thereby perform the printing operation while the TA paper 20 is being transported in the direction indicated by the arrow. As a result, the printing of the M color is performed on the TA paper 20.

Next, after the control section 50 has output to the pulse motor 32 pulses in accordance with the distance the printed distal end portion is to travel between the feed roller 27 and the pinch roller 28, the control section 50 turns on the M color fixing lamp 29 and fixes the M color on the TA paper 20. As a result, color formation of the M color does not occur thereafter on the TA paper 20 even if heat is applied from the thermal head 21.

After the M color printing operation has been completed, when the end portion on which the M color has been printed is transported to the left side of the feed roller 27, the control section 50 stops the rotation of the pulse motor 32 in accordance with a predetermined time required for the fixing of the M color. Thereafter the M color fixing lamp 29 is turned off, the thermal head 21 is lifted up and the thermal head 21 and the platen roller 22 are separated. Next, the feed roller 27 is rotated in a clockwise direction so that the rear end portion of the TA paper 20 is transported in the direction indicated by the arrow in FIG. 15.

When the TA paper 20 is transported such that the distal end portion of the TA paper 20 is detected by the sensor 45, the control section 50 lowers the pinch roller 24 placing it in press contact with the feed roller 23. The thermal head 21 is also lowered placing it in press contact with the platen roller 22. In addition, the pinch roller 28 is lifted up, separating the pinch roller 28 from the feed roller 27. By then rotating the feed roller 23, the TA paper 20 is transported in the direction indicated by the arrow in FIG. 15.

The control section 50 then outputs to the pulse motor 32 a pulse number that accords with the distance to travel from the distal end portion of the TA paper 20 to the printing start position for the C (cyan) color. The pulse motor 32 rotates in accordance with the output pulse number thereby rotating the feed roller 23 via the belt 34 and pulley 31. The C color printing start position of the TA paper 20 is thus transported to a position directly below the thermal head 21.

Next, the control section 50 performs the control of the heating process operation for the C color in accordance with the image being printed. Subsequently, the control section 50 rotates the pulse motor 32 so as to rotate the feed roller 27 and thereby perform the C color printing operation while the TA paper 20 is being transported in the direction indicated by the arrow. As a result, the printing of the C color is performed on the TA paper 20. After the printing of the C color has been completed, the control section 50 discharges the TA paper 20 via the paper discharge roller thus completing the printing process.

Figure 18:
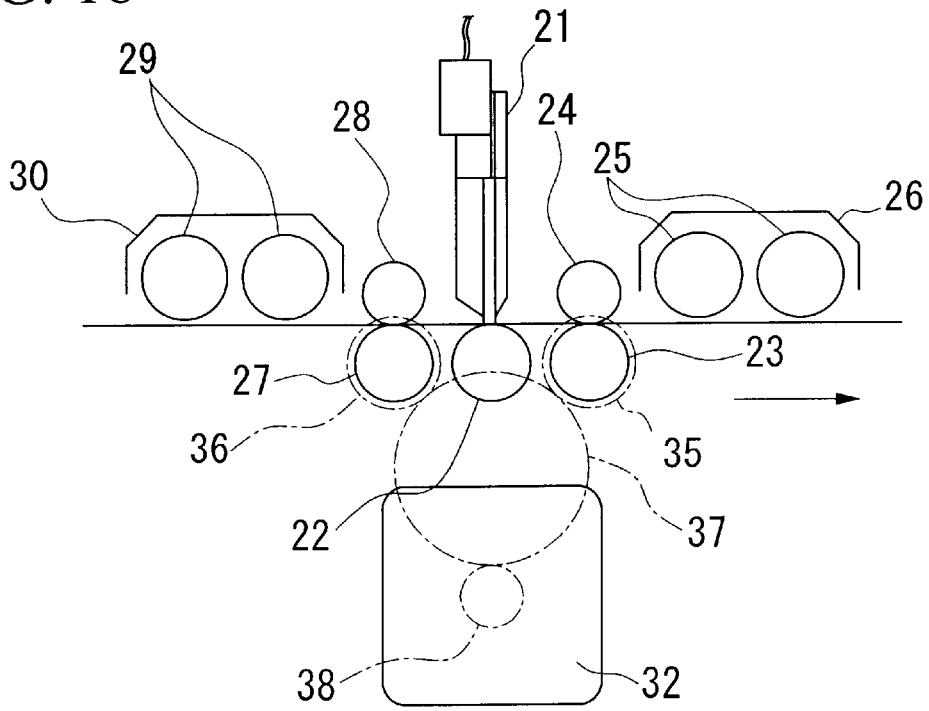
FIG. 18 is a schematic structural diagram showing the structure of the thermal printer in the thirteenth embodiment of the present invention.
Figure 19:
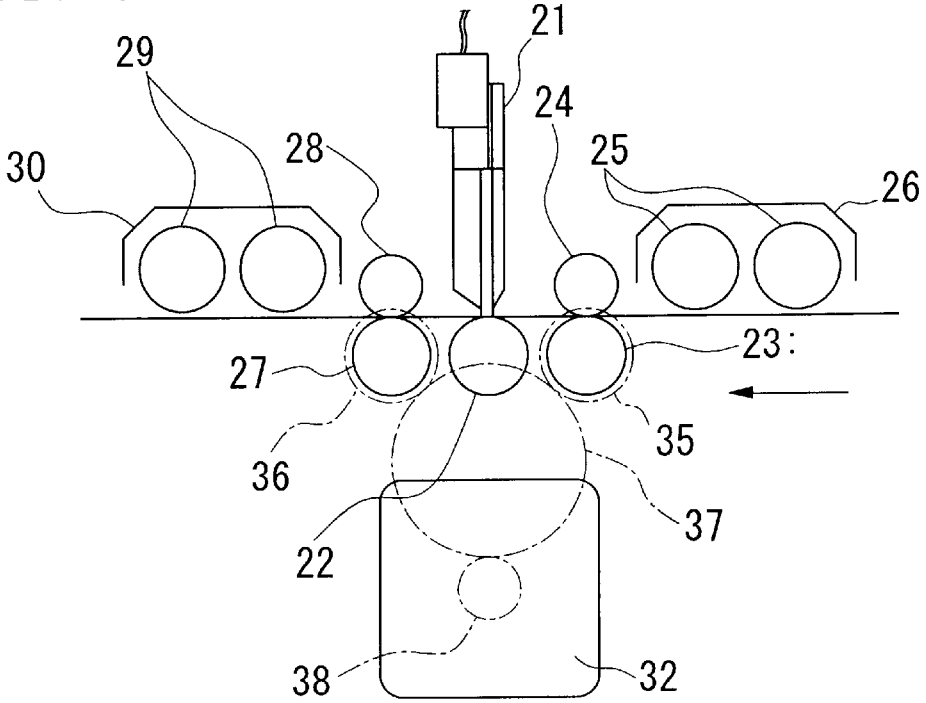
FIG. 19 is a schematic structural diagram representing the state when the transporting direction is reversed in the thermal printer shown in FIG. 18.

Next, a description will be given of the thirteenth embodiment of the present invention using FIGS. 18 and 19. In FIGS. 18 and 19, the transmission means for the power output from the pulse motor 32 in FIG. 15, namely, the belt 34, the pulley 31, and the pulley 39 have been replaced with an idle gear 37, a clutch 35, and a clutch 36. In FIG. 18, the rotation shaft of the pulse motor 32 is linked to the idle gear 37 via a gear 38, and the clutch 35 and the clutch 36 are also linked to the idle gear 37. The clutch 35 is engaged with the feed roller 23 and when the clutch 36 is disengaged, the TA paper is transported in the direction indicated by the arrow in FIG. 18 (i.e. towards the right) by the rotation of the pulse motor 32.

In contrast, FIG. 19 shows the state when the clutch 35 is disengaged and the clutch 36 is engaged with the feed roller 27. In this case, the TA paper is transported in the direction indicated by the arrow in FIG. 19 (i.e. towards the left) by the rotation of the pulse motor 32. In this embodiment, the operations to engage and disengage the clutch 35 and the clutch 36 are controlled by the control section 50. Moreover, in FIGS. 18 and 19, because the rotation force is transmitted by the engaging and disengaging of the clutches 35 and 36, the pinch roller 24 and the pinch roller 28 are placed in constant press contact with the feed roller 23 and the feed roller 27. Because the remainder of the printing operation is the same as in the twelfth embodiment, a description thereof is omitted.

Next, a description will be given of the fourteenth embodiment of the present invention using FIGS. 32 through 37.

In the above embodiments, the shape of the magnets and the mounting positions were determined experimentally by experience and intuition so as to obtain a uniform illumination intensity distribution. In the fourteenth embodiment, a method is described that enables the shape of the magnets of the hot cathode fluorescent tube to be optimized by calculation, that enables the illumination intensity to be increased and made more uniform, and that enables the uniform illumination intensity range to be expanded without having to rely on experience and intuition.

Firstly, an outline of the procedure for calculating the shape of the magnets using numerical analysis according to the finite element method will be described.

Figure 32:
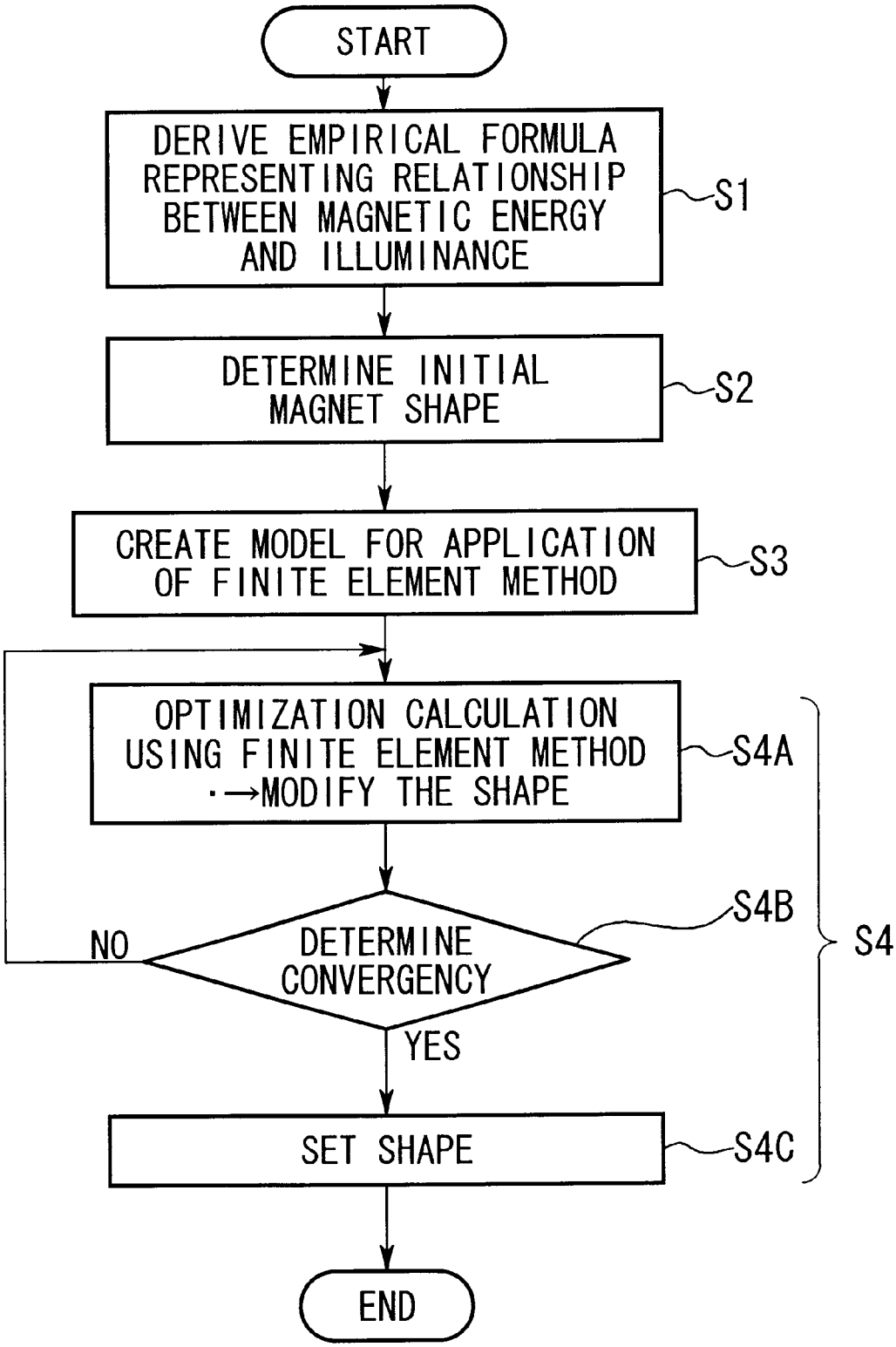
FIG. 32 is a flow chart showing the optimized procedure of the fourteenth embodiment of the present invention.

In FIG. 32 the procedure for calculating the shape of a magnet using the finite element method is shown. In step S1 shown in this diagram, the magnetic flux density of an area corresponding to the inside of a fluorescent tube is measured using a plurality of magnets having different magnetic force. From the values measured, an empirical formula is derived that represents the relationship between the illumination intensity and the magnetic energy density. Furthermore, using this empirical formula, an evaluation function that forms an index for evaluating the magnet shape is derived. In step S2, the initial shape of the magnet (i.e. the initial value for the shape) in the numerical analysis is determined. In step S3, a model of a fluorescent tube to be used for applying the finite element method is created.

In step S4, the magnet shape is optimized by applying the finite element method to the model of a fluorescent tube created in step S3. Namely, optimization calculation is performed according to the finite element method by changing the magnet shape with the shape of the magnet determined in step S2 as the initial value while evaluating the magnet shapes using the aforementioned evaluation function (step S4A). Next, a determination is made as to whether or not the results of the optimization calculation converge (step S4B). If the calculation results do not converge (i.e. if the determination in step S4B is NO), the optimization calculation is repeated. If the calculation results do converge (i.e. if the determination in step S4B is YES), the shape of the magnet is set from the calculation results at that time (step S4C).

The contents of the above described procedure will now be described in detail.

A. Empirical Formula Representing the Relationship Between the Magnetic Energy and the Illumination Intensity An empirical formula representing the relationship between the illumination intensity and the magnetic energy density is derived on the basis of data obtained by measuring the relationship between the illumination intensity and magnetic flux density. Here, the relationship between the two is derived due to it being considered that as, a result of the magnetic energy being converted into kinetic energy of the mercury vapor, the number of times it collides with the fluorescent coating is increased thereby raising the illumination intensity.

(a) Measuring the Illumination Intensity

The illumination intensity distribution of the fluorescent tube is determined by actual measurement.

Figure 33A:
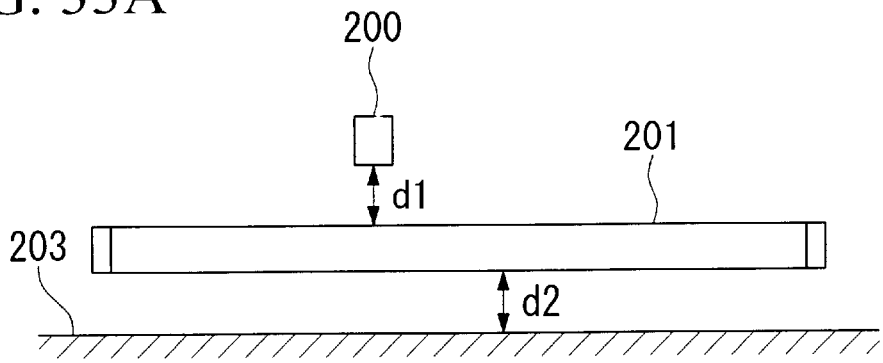
FIGS. 33A and 33B are views showing the values actually measured for the illumination intensity.

FIG. 33A shows the positional relationships between an illumination intensity meter 200, a fluorescent tube 201, and a magnet 203 at the time the illumination intensity distribution was measured. In this example, the effective length (i.e. the length apart from the cap portions) of the fluorescent tube 201 is 280 mm. The distance d1 from the surface of the magnet 203 to the surface of the fluorescent tube 201 is 6 mm for a magnet with low magnetic force and 6.7 mm for a magnet with high magnetic force. The distance between the illumination intensity meter 200 and the fluorescent tube 201 is 8 mm.

Figure 33B:
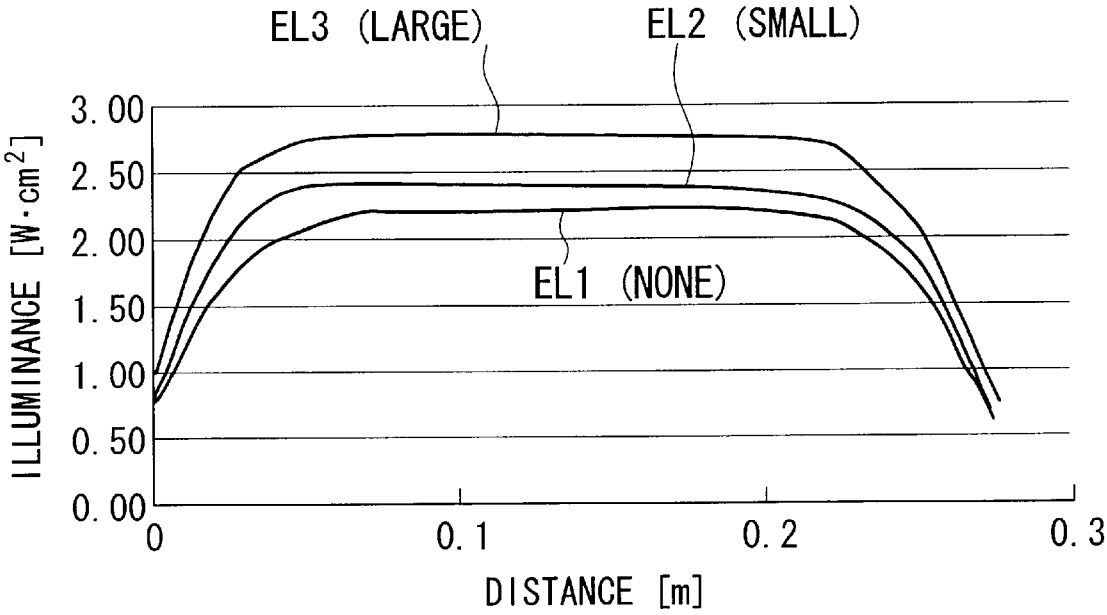

FIG. 33B is a graph showing an example of values measured for the illumination intensity distribution of the fluorescent tube 201. The horizontal axis in FIG. 33B is the distance from the left side of the effective length of the fluorescent tube 201 minus the cap portion, while the vertical axis is the illumination intensity at positions specified by the distance on the horizontal axis. The curved line EL1 in the graph represents the illumination intensity distribution when no magnet is mounted, the curved line EL2 represents the illumination intensity distribution when the magnet with low magnetic force is mounted, while the curved line EL3 represents the illumination intensity when the magnet with high magnetic force is mounted. As can be understood from this graph, when the shape of the magnets has not been optimized, the illumination intensities in the vicinities of the end portions of the fluorescent tube are greatly reduced and the illumination intensity is not uniform.

(b) Measuring the Magnetic Flux Density

Figures 34A, 34B:
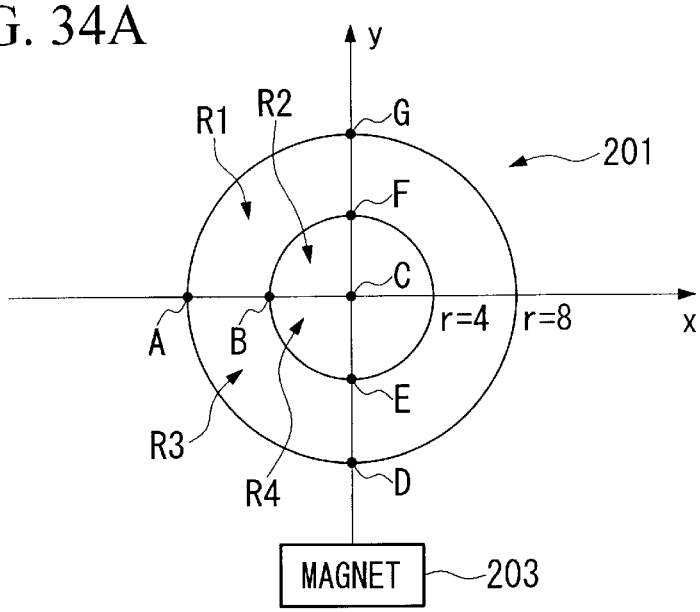
FIGS. 34A and 34B are views showing the values actually measured for the magnetic flux density.

The magnetic flux density inside the fluorescent tube 201 is determined by actual measurement. FIG. 34A shows the points A to G where the magnetic flux of the magnet 203 was measured. Taking the center axis of the fluorescent tube 201 as the point of origin (the point C), the measurement points were set on two circumferences that had radiuses r of 4 mm and 8 mm respectively. FIG. 34B shows the values measured for the magnetic flux density at the measurement points A to G and shows an instance of the values measured when the magnet with high magnetic force was used as the magnet 203 and of the values measured when the magnet with low magnetic force was used as the magnet 203. In this way, the magnetic flux density was measured at the respective measurement points using a plurality of magnets each having different magnetic force.

(c) Derivation of the Relational Expression Between the Magnetic Energy Density and the Illumination Intensity The magnetic energy density is calculated from the above described values measured for the magnetic flux density, and the relationship between the magnetic energy density and the illumination intensity determined.

Firstly, the magnetic flux density B at an arbitrary point on the system of coordinates shown in FIG. 34A is approximated using Formula (1) below.

$$B=a\cdot r+b\cdot\theta+c\cdot r\cdot\theta+d \quad (1)$$

Wherein a, b, c, and d are coefficients, r is a variable representing the distance from the point of origin (the point C) in the circumferential system of coordinates, and θ is a variable representing the angle of rotation on the circumferential system of coordinates.

Looking next at the point at which the magnetic energy U is proportional to the inner product of vectors of the magnetic flux density B (i.e. B·B), for the areas R1 to R4 shown in FIG. 34A, the magnetic energy density w is determined by setting the coefficients a to d of Formula (1) and integrating $B^2$ using the variables r and θ, and then by totaling the integral values of each area and dividing by the total area. In the example shown in FIG. 34B, when the magnet having a high magnetic force is used, a magnetic energy density of $9.179\times10^{-4}$ was obtained. When the magnet having a low magnetic force was used, a magnetic energy density of $3.347\times10^{-4}$ was obtained.

Next, the relationship between the magnetic energy density w and the illumination intensity E was approximated using the quadratic formula shown in Formula (2).

$$E=a_1w^2+b_1w+c_1 \quad (2)$$

Wherein $a_1$, $b_1$, and $c_1$ are coefficients.

If the value of the illumination intensity and the magnetic energy density w calculated from the aforementioned magnetic energy U are substituted in formula (2) and apposed, the coefficients $a_1$, $b_1$, and $c_1$ are determined. In the present embodiment, the coefficients $a_1$ , $b_1$, and $c_1$ are calculated from the relationship between the illumination and the magnetic energy density obtained for positions from the end of the fluorescent tube of 100 mm, 150 mm, and 200 mm. Among these, the coefficients $a_1=-8.17\times10^4$, $b_1=6.61\times10^2$, and $c_1=2.19$ that were obtained for the position at 150 mm, which had the least divergence in the illumination intensity, were employed. The derivation process for these coefficients is described below.

Figure 35:
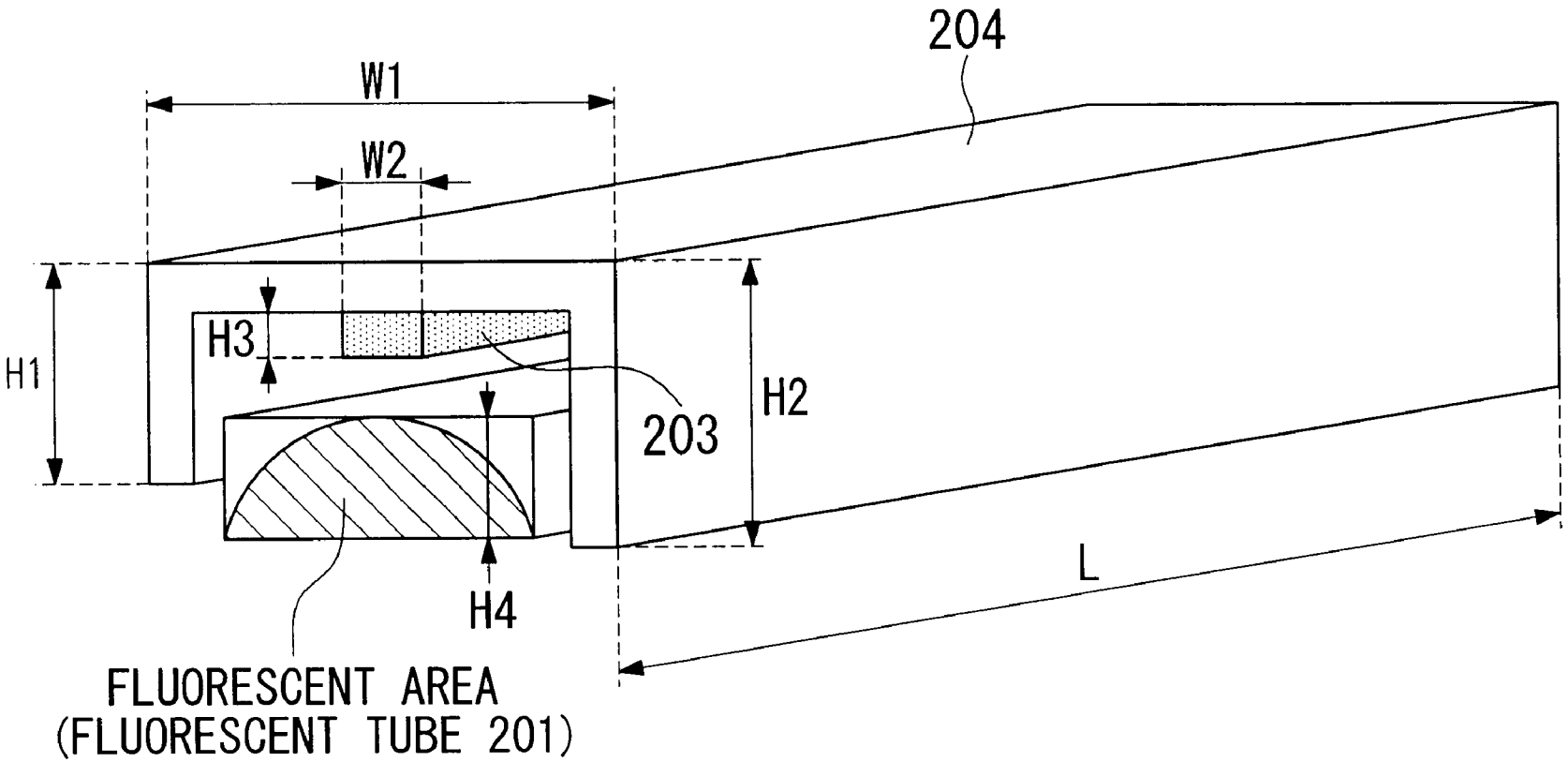
FIG. 35 is a view showing an example of a model of a fluorescent tube.

2. Magnet Shape Optimization Calculation Using the Finite Element Method (a) Formation of a Fluorescent Tube Model A model of a fluorescent tube used for the application of the finite element method was created. FIG. 35 shows an example of a model of a fluorescent tube. In FIG. 35 the symbol 204 indicates a frame formed from a ferromagnetic material and having a U shaped cross section. In the present embodiment, the width W1 of the frame 204 was set at 22.5 mm, the length thereof was set at 280 mm, the height H1 of one side wall was set at 10.25 mm, the height of the other side wall H2 was set at 15 mm, and the thickness (no descriptive symbol) of the frame 204 was set at 1 mm. The frame 204 was positioned so as to cover a portion of the fluorescent tube 201.

The symbol 203 indicates a magnet (having a width W2 and a height H3) disposed on the frame 204 so as to face the fluorescent tube 201 and extending in the longitudinal direction of the fluorescent tube 201. A magnetic circuit is formed by the magnet 203 and the frame 204. In the present embodiment, the width W2 of the magnet 203 is changed and the shape of the magnet 203 is changed so that illumination intensity distribution of the semicircular fluorescent area having the height H4 shown in FIG. 35 is made constant. In the present embodiment, the height H4 is set at 7.75 mm.

Figure 36:
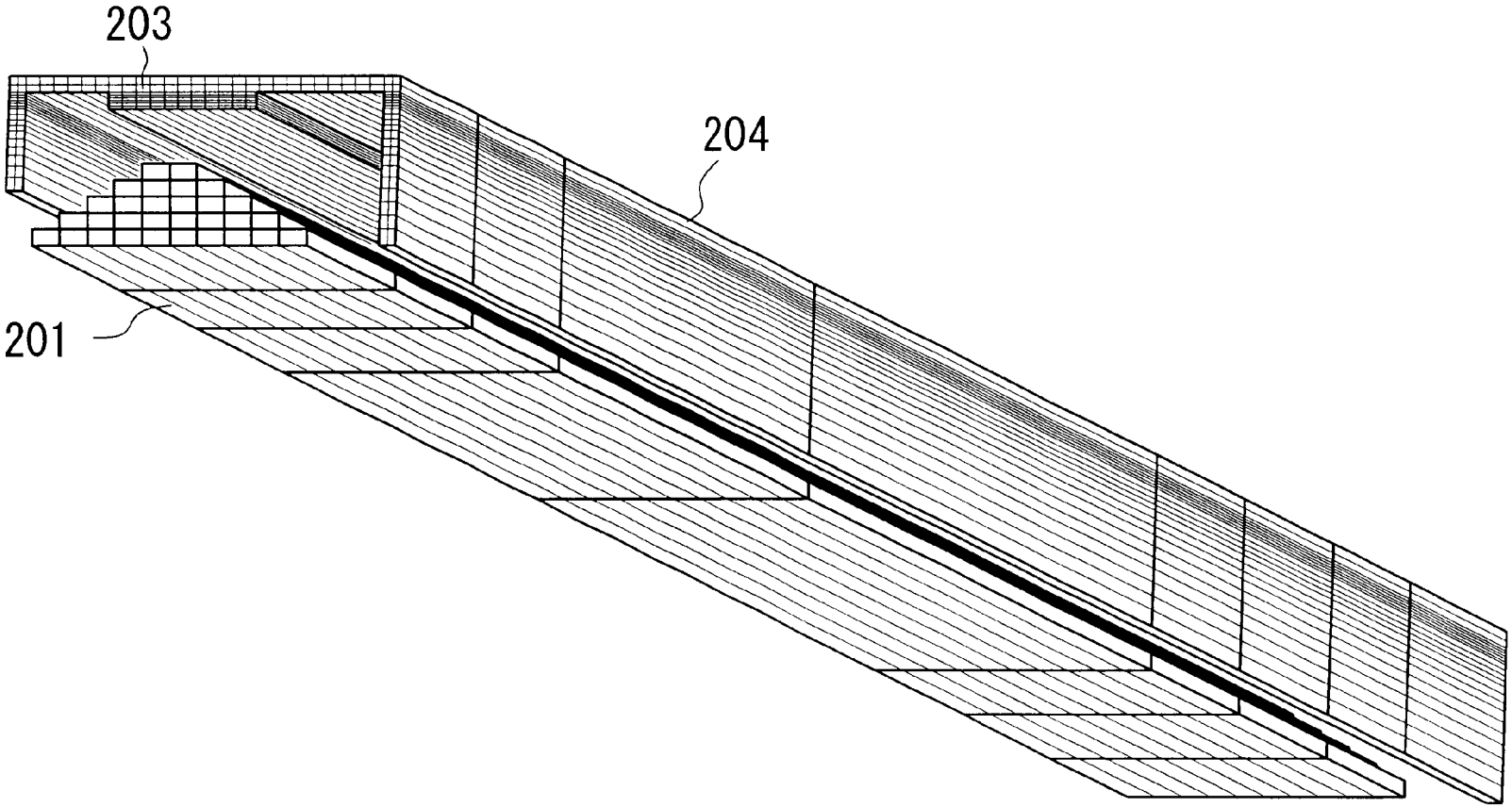
FIG. 36 is a view showing a split image of a fluorescent tube model.
Figure 37:
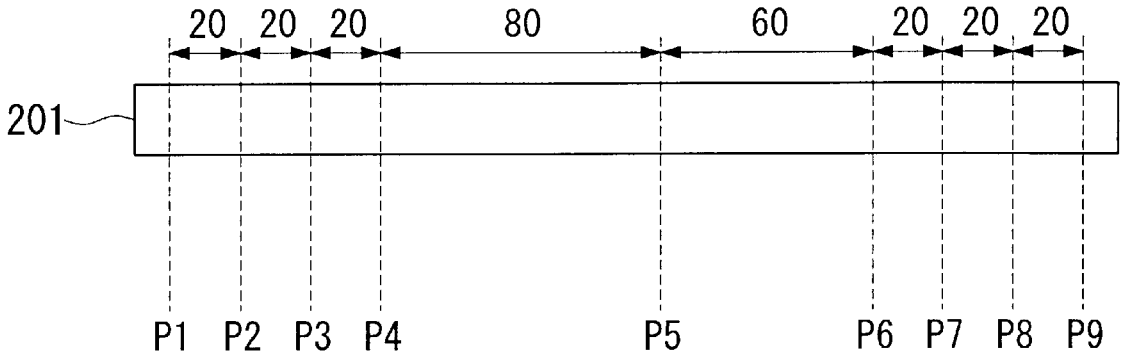
FIG. 37 is a view used for describing the slice split positions of the fluorescent tube model.

FIG. 36 shows a split image of a fluorescent tube model. The numerical analysis performed using the finite element method is carried out for each element set in these split positions. In the example shown in FIG. 37, the split positions P1 to P4 and P6 to P9 are set at 20 mm intervals. In addition, the interval between the split position P4 and P5 is set to 80 mm, while the interval between the split position P5 and P6 is set to 60 mm. As is shown in this diagram, the intervals of the splits in the vicinity of the caps of the fluorescent tube are set at a small size. By making slice splits in this way, the numerical analysis at both ends where the illumination intensity distribution changes can be performed with a high level of accuracy.

(b) Evaluation Coefficient

The evaluation coefficient χ used when optimizing the shape of the magnet. In the present embodiment, Formula (3) below is employed as χ such that the value when the shape of the magnet has been optimized is at 0.

$$\chi=E_{obj}/E_{av}-1)^2 \quad (3)$$

Wherein $E_{obj}$ indicates the illumination intensity obtained by substituting the average illumination intensity at each slice position when no magnet is mounted in the above Formula (2) for the coefficient $C_1$. $E_{av}$ indicates the average illumination intensity at each slice position when a magnet is mounted in the above Formula (2).

(c) Optimization Calculation (Numerical Analysis Using the Finite Element Method)

When the illumination intensity E obj is equal to the average illumination intensity E av and the shape of the magnet has been optimized according to the evaluation coefficient χ shown in Formula (3), the coefficient value is close to zero. In the present embodiment, the width W2 of the magnet is used as the design variable representing the shape of the magnet, and the width W2 of the magnet is optimized at each slice split position using the finite element method such that the evaluation coefficient χ becomes close to zero. In the present embodiment, the initial value of the width W2 of the magnet is set to 1 mm, and this width W2 of the magnet is varied between 1 and 13 mm so as to determine the optimum magnet width.

(d) Results of the Numerical Analysis Using the Finite Element Method

Figure 38:
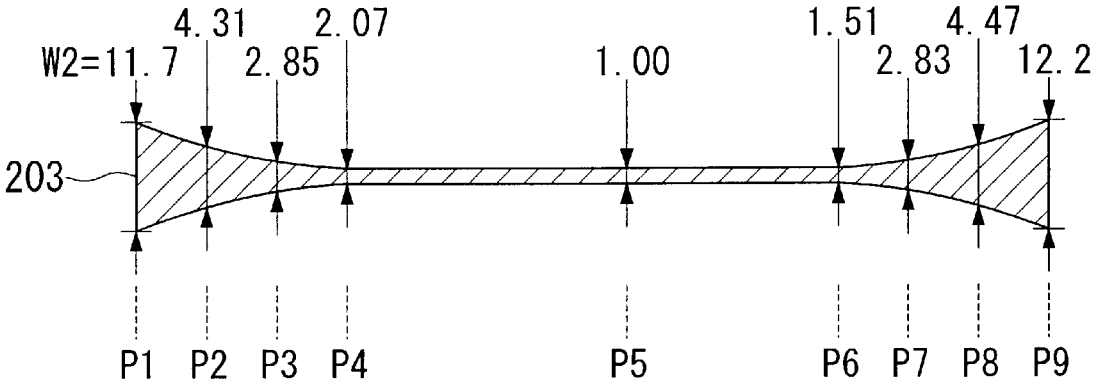
FIG. 38 is a view showing the shape (widthwise) of an optimized magnet.

In FIG. 38 the width W2 of the magnet at each slice split position obtained as a result of the optimization calculation is shown. As is shown in this drawing, the width W2 of the magnet is large in the vicinity of the cap where the illumination intensity is low when no magnet has been mounted. Moreover, the width W2 of the magnet remains at the initial value of 1 mm in the vicinity of the center where the illumination intensity distribution is high. In this way, according to the fourteenth embodiment, without relying on experience or intuition, the width W2 of the magnet is set by numerical analysis so as to compensate for the reduction in the illumination intensity and an illumination intensity distribution that is uniform and at a high level can be obtained over the entire longitudinal direction of the fluorescent tube.

Next, a detailed description will be given for reference of the derivation process for the coefficients of the empirical formula shown in Formula (2) above.

Firstly, using the measurement values shown in FIG. 34B, each coefficient of a formula representing the magnetic flux density B on the circumferential system of coordinates shown in Formula (1) above is determined.

In the area R1 shown in FIG. 34A, the x component and the y component of the magnetic flux density B are looked at separately.

Formula (10A) representing the x components of the magnetic flux density B (B1*x* to B4*x*) in the area R1 is obtained from the measurement values when the magnet shown in FIG. 34B that has a large magnetic force is used. Formula (10B) is obtained by re-expressing the x components of the magnetic density flux (B1*x* to B4*x*) after substituting r and θ representing the measurement points on the circumferential system of coordinates in Formula (1). Formula (10C) is obtained from the formulas (10A) and (10B). Formula (10C) gives the coefficients (ax, bx, cx, and dx) of the x components of the magnetic flux density B in the area R1 as the coefficients (a, b, c, and d) in Formula (1). In the same way, the formulas (10D) and (10E) representing the y components of the magnetic flux density B (B1*y* to B4*y*) in the area R1 are obtained. Formula (10F) is obtained from the formulas (10D) and (10E). Formula (10F) gives the coefficients (ay, by, cy, and dy) of the y components of the magnetic flux density B in the area R1 as the coefficients (a, b, c, and d) in Formula (1).

$$\begin{bmatrix} B1x \\ B2x \\ B3x \\ B4x \end{bmatrix} = \begin{bmatrix} 0 \\ 0 \\ 0.0245 \\ 0.0356 \end{bmatrix} \tag{10A}$$

$$\begin{bmatrix} B1x \\ B2x \\ B3x \\ B4x \end{bmatrix} = \begin{bmatrix} 4\cdot10^{-3} & 0 & 0 & 1 \\ 8\cdot10^{-3} & 0 & 0 & 1 \\ 4\cdot10^{-3} & \frac{\pi}{2} & 2\cdot\pi\cdot10^{-3} & 1 \\ 8\cdot10^{-3} & \frac{\pi}{2} & 4\cdot\pi\cdot10^{-3} & 1 \end{bmatrix} \cdot \begin{bmatrix} ax \\ bx \\ cx \\ dx \end{bmatrix} \tag{10B}$$

$$\begin{bmatrix} ax \\ bx \\ cx \\ dx \end{bmatrix} = \begin{bmatrix} 0 \\ 8.531\cdot10^{-3} \\ 1.767 \\ 0 \end{bmatrix} \tag{10C}$$

-continued $$\begin{bmatrix} B1y \\ B2y \\ B3y \\ B4y \end{bmatrix} = \begin{bmatrix} 0.022 \\ 0.013 \\ 0.03 \\ 0.015 \end{bmatrix} \tag{10D}$$

$$\begin{bmatrix} B1y \\ B2y \\ B3y \\ B4y \end{bmatrix} = \begin{bmatrix} 4\cdot10^{-3} & 0 & 0 & 1 \\ 8\cdot10^{-3} & 0 & 0 & 1 \\ 4\cdot10^{-3} & \frac{\pi}{2} & 2\cdot\pi\cdot10^{-3} & 1 \\ 8\cdot10^{-3} & \frac{\pi}{2} & 4\cdot\pi\cdot10^{-3} & 1 \end{bmatrix} \cdot \begin{bmatrix} ay \\ by \\ cy \\ dy \end{bmatrix} \tag{10E}$$

$$\begin{bmatrix} ay \\ by \\ cy \\ dy \end{bmatrix} = \begin{bmatrix} -2.25 \\ 8.913\cdot10^{-3} \\ -0.955 \\ 0.031 \end{bmatrix} \tag{10F}$$

In the same way, the coefficients (a2*x* to d2*x*) of the x components of the magnetic flux density B and the coefficients (a2*y* to d2*y*) of the y components of the magnetic flux density B are determined in Formula (1) for the area R2. These calculation processes are shown in the formulas (11A) to (11F).

$$\begin{bmatrix} B1x \\ B2x \\ B3x \\ B4x \end{bmatrix} = \begin{bmatrix} 0 \\ 0 \\ 0 \\ 0.0245 \end{bmatrix} \tag{11A}$$

$$\begin{bmatrix} B1x \\ B2x \\ B3x \\ B4x \end{bmatrix} = \begin{bmatrix} 0 & 0 & 0 & 1 \\ 4\cdot10^{-3} & 0 & 0 & 1 \\ 0 & \frac{\pi}{2} & 0 & 1 \\ 4\cdot10^{-3} & \frac{\pi}{2} & 2\cdot\pi\cdot10^{-3} & 1 \end{bmatrix} \begin{bmatrix} a2x \\ b2x \\ c2x \\ d2x \end{bmatrix} \tag{11B}$$

$$\begin{bmatrix} a2x \\ b2x \\ c2x \\ d2x \end{bmatrix} = \begin{bmatrix} 0 \\ 0 \\ 3.899 \\ 0 \end{bmatrix} \tag{11C}$$

$$\begin{bmatrix} B1y \\ B2y \\ B3y \\ B4y \end{bmatrix} = \begin{bmatrix} 0.038 \\ 0.022 \\ 0.038 \\ 0.03 \end{bmatrix} \tag{11D}$$

$$\begin{bmatrix} B1y \\ B2y \\ B3y \\ B4y \end{bmatrix} = \begin{bmatrix} 0 & 0 & 0 & 1 \\ 4\cdot10^{-3} & 0 & 0 & 1 \\ 0 & \frac{\pi}{2} & 0 & 1 \\ 4\cdot10^{-3} & \frac{\pi}{2} & 2\cdot\pi\cdot10^{-3} & 1 \end{bmatrix} \cdot \begin{bmatrix} a2y \\ b2y \\ c2y \\ d2y \end{bmatrix} \tag{11E}$$

$$\begin{bmatrix} a2y \\ b2y \\ c2y \\ d2y \end{bmatrix} = \begin{bmatrix} -4 \\ 0 \\ 1.273 \\ 0.038 \end{bmatrix} \tag{11F}$$

In the same way, the coefficients (a3*x* to d3*x*) of the x components of the magnetic flux density B and the coefficients (a3*y* to d3*y*) of the y components of the magnetic flux density B are determined in Formula (1) for the area R3. These calculation processes are shown in the formulas (12A) to (12F).

$$\begin{bmatrix} B1x \\ B2x \\ B3x \\ B4x \end{bmatrix} = \begin{bmatrix} 0.0245 \\ 0.0356 \\ 0.0 \\ 0.0 \end{bmatrix} \tag{12A}$$

$$\begin{bmatrix} B1x \\ B2x \\ B3x \\ B4x \end{bmatrix} = \begin{bmatrix} 4\cdot10^{-3} & \frac{\pi}{2} & 2\cdot\pi\cdot10^{-3} & 1 \\ 8\cdot10^{-3} & \frac{\pi}{2} & 4\cdot\pi\cdot10^{-3} & 1 \\ 4\cdot10^{-3} & \pi & 4\cdot\pi\cdot10^{-3} & 1 \\ 8\cdot10^{-3} & \pi & 8\cdot\pi\cdot10^{-3} & 1 \end{bmatrix} \cdot \begin{bmatrix} a3x \\ b3x \\ c3x \\ d3x \end{bmatrix} \tag{12B}$$

$$\begin{bmatrix} a3x \\ b3x \\ c3x \\ d3x \end{bmatrix} = \begin{bmatrix} 5.55 \\ -8.531\cdot10^{-3} \\ -1.767 \\ 0.027 \end{bmatrix} \tag{12C}$$

$$\begin{bmatrix} B1y \\ B2y \\ B3y \\ B4y \end{bmatrix} = \begin{bmatrix} 0.03 \\ 0.015 \\ 0.05 \\ 0.01 \end{bmatrix} \tag{12D}$$

$$\begin{bmatrix} B1y \\ B2y \\ B3y \\ B4y \end{bmatrix} = \begin{bmatrix} 4\cdot10^{-3} & 0 & 0 & 1 \\ 8\cdot10^{-3} & 0 & 0 & 1 \\ 4\cdot10^{-3} & \frac{\pi}{2} & 2\cdot\pi\cdot10^{-3} & 1 \\ 8\cdot10^{-3} & \frac{\pi}{2} & 4\cdot\pi\cdot10^{-3} & 1 \end{bmatrix} \cdot \begin{bmatrix} a3y \\ b3y \\ c3y \\ d3y \end{bmatrix} \tag{12E}$$

$$\begin{bmatrix} a3y \\ b3y \\ c3y \\ d3y \end{bmatrix} = \begin{bmatrix} 2.5 \\ 0.029 \\ -3.979 \\ 0 \end{bmatrix} \tag{12F}$$

In the same way, the coefficients (a4$x$ to d4$x$) of the x components of the magnetic flux density B and the coefficients (a4$y$ to d4$y$) of the y components of the magnetic flux density B are determined in Formula (1) for the area R4. These calculation processes are shown in the formulas (13A) to (13F).

$$\begin{bmatrix} B1x \\ B2x \\ B3x \\ B4x \end{bmatrix} = \begin{bmatrix} 0 \\ 0.0245 \\ 0.0 \\ 0.0 \end{bmatrix} \tag{13A}$$

$$\begin{bmatrix} B1x \\ B2x \\ B3x \\ B4x \end{bmatrix} = \begin{bmatrix} 0 & \frac{\pi}{2} & 0 & 1 \\ 4\cdot10^{-3} & \frac{\pi}{2} & 2\cdot\pi\cdot10^{-3} & 1 \\ 0 & \pi & 0 & 1 \\ 4\cdot10^{-3} & \pi & 4\cdot\pi\cdot10^{-3} & 1 \end{bmatrix} \cdot \begin{bmatrix} a4x \\ b4x \\ c4x \\ d4x \end{bmatrix} \tag{13B}$$

$$\begin{bmatrix} a4x \\ b4x \\ c4x \\ d4x \end{bmatrix} = \begin{bmatrix} 12.25 \\ 0 \\ -3.899 \\ 0 \end{bmatrix} \tag{13C}$$

$$\begin{bmatrix} B1y \\ B2y \\ B3y \\ B4y \end{bmatrix} = \begin{bmatrix} 0.038 \\ 0.03 \\ 0.038 \\ 0.05 \end{bmatrix} \tag{13D}$$

-continued $$\begin{bmatrix} B1y \\ B2y \\ B3y \\ B4y \end{bmatrix} = \begin{bmatrix} 0 & \frac{\pi}{2} & 0 & 1 \\ 4\cdot10^{-3} & \frac{\pi}{2} & 2\cdot\pi\cdot10^{-3} & 1 \\ 0 & \pi & 0 & 1 \\ 4\cdot10^{-3} & \pi & 4\cdot\pi\cdot10^{-3} & 1 \end{bmatrix} \cdot \begin{bmatrix} a4y \\ b4y \\ c4y \\ d4y \end{bmatrix} \tag{13E}$$

$$\begin{bmatrix} a4y \\ b4y \\ c4y \\ d4y \end{bmatrix} = \begin{bmatrix} -7 \\ 0 \\ 3.183 \\ 0.038 \end{bmatrix} \tag{13F}$$

Next, the coefficients (a5$x$ to d5$x$), (a6$x$ to d6$x$), (a7$x$ to d7$x$), and (a8$x$ to d8$x$) that give the x components in the magnetic flux density B and the coefficients (a5$y$ to d5$y$), (a6$y$ to d6$y$), (a7$y$ to d7$y$), and (a8$y$ to d8$y$) that give the y components in the magnetic flux density B in Formula (1) are determined for the areas R1 to R4 in the same way from the measurement values when the magnet shown in FIG. 34B that has a small magnetic force is used. These calculation results are shown in Formulas (14) to (17).

$$\begin{bmatrix} a5x \\ b5x \\ c5x \\ d5x \end{bmatrix} = \begin{bmatrix} 0 \\ 9.167\cdot10^{-3} \\ -0.35 \\ 0 \end{bmatrix}, \begin{bmatrix} a5y \\ b5y \\ c5y \\ d5y \end{bmatrix} = \begin{bmatrix} 0.625 \\ 7.958\cdot10^{-3} \\ -1.114 \\ 2\cdot10^{-3} \end{bmatrix} \tag{14}$$

$$\begin{bmatrix} a6x \\ b6x \\ c6x \\ d6x \end{bmatrix} = \begin{bmatrix} 0 \\ 0 \\ 1.942 \\ 0 \end{bmatrix}, \begin{bmatrix} a6y \\ b6y \\ c6y \\ d6y \end{bmatrix} = \begin{bmatrix} 1.625 \\ -3.82\cdot10^{-3} \\ 0.875 \\ 7\cdot10^{-3} \end{bmatrix} \tag{15}$$

$$\begin{bmatrix} a7x \\ b7x \\ c7x \\ d7x \end{bmatrix} = \begin{bmatrix} -1.1 \\ -9.167\cdot10^{-3} \\ 0.35 \\ 0.029 \end{bmatrix}, \begin{bmatrix} a7y \\ b7y \\ c7y \\ d7y \end{bmatrix} = \begin{bmatrix} -10 \\ -0.015 \\ 5.65 \\ 0.039 \end{bmatrix} \tag{16}$$

$$\begin{bmatrix} a8x \\ b8x \\ c8x \\ d8x \end{bmatrix} = \begin{bmatrix} 6.1 \\ 0 \\ -1.942 \\ 0 \end{bmatrix}, \begin{bmatrix} a8y \\ b8y \\ c8y \\ d8y \end{bmatrix} = \begin{bmatrix} -2.475 \\ 0 \\ 1.448 \\ 0.013 \end{bmatrix} \tag{17}$$

As a result of the above, each coefficient of Formula (1) representing the magnetic flux density B in the circumferential system of coordinates is obtained for when a magnet having a large magnetic force is used and for when a magnet having a small magnetic force is used.

Next, the magnetic energy density is determined using Formula (1).

Generally, the magnetic energy density w, is represented by the following Formula (18).

$$wi = \frac{1}{2S}\int\int_S H\cdot B\,ds = \frac{1}{2\mu S}\int\int_S B\cdot B\,ds \tag{18}$$

Wherein S is the surface area (in the present embodiment, S is the surface area of the areas R1 to R4). Moreover, $\mu$ is the magnetic permeability.

The details of the calculation formula for the integration portion in Formula (18) when the magnet having a large magnetic force shown in FIG. 34B is used are shown in Formulas (20A) to (20D) for the areas R1 to R4. In these formulas, bb1 to bb4 represents the respective calculation results of the integration portion for the areas R1 to R4. In this embodiment, bb1=2.655×10$^{-8}$, bb2=1.27×10$^{-8}$, bb3=3.755×10$^{-8}$, and bb4=2.091×10$^{-8}$ are obtained. The magnetic energy density w when the magnet having a large magnetic force is used is represented by Formula (20E) and is obtained by totaling the calculation results of Formulas (20A) to (20D) and dividing this by the surface area of the areas R1 to R4. In the present embodiment, 9.719×10$^{-4}$ is obtained as the magnetic energy density w.

$$bb1 = \int_{4\cdot10^{-3}}^{8\cdot10^{-3}} \int_0^{\frac{\pi}{2}} [(ax\cdot r + bx\cdot\theta + cx\cdot r\cdot\theta + dx)^2 + (ay\cdot r + by\cdot\theta + cy\cdot r\cdot\theta + dy)^2]\cdot r\,d\theta\,dr \tag{20A}$$

$$bb2 = \int_0^{4\cdot10^{-3}} \int_0^{\frac{\pi}{2}} [(a2x\cdot r + b2x\cdot\theta + c2x\cdot r\cdot\theta + d2x)^2 + (a2y\cdot r + b2y\cdot\theta + c2y\cdot r\cdot\theta + d2y)^2]\cdot r\,d\theta\,dr \tag{20B}$$

$$bb3 = \int_{4\cdot10^{-3}}^{8\cdot10^{-3}} \int_{\frac{\pi}{2}}^{\pi} [(a3x\cdot r + b3x\cdot\theta + c3x\cdot r\cdot\theta + d3x)^2 + (a3y\cdot r + b3y\cdot\theta + c3y\cdot r\cdot\theta + d3y)^2]\cdot r\,d\theta\,dr \tag{20C}$$

$$bb4 = \int_0^{4\cdot10^{-3}} \int_{\frac{\pi}{2}}^{\pi} [(a4x\cdot r + b4x\cdot\theta + c4x\cdot r\cdot\theta + d4x)^2 + (a4y\cdot r + b4y\cdot\theta + c4y\cdot r\cdot\theta + d4y)^2]\cdot r\,d\theta\,dr \tag{20D}$$

$$w = \frac{(bb1 + bb2 + bb3 + bb4)}{\frac{(8\cdot10^{-3})^2\cdot\pi}{2}} \tag{20E}$$

In the same way, the details of the calculation formula for the integration portion in Formula (18) when the magnet having a small magnetic force shown in FIG. 34B is used are shown in Formulas (21A) to (21D) for the areas R1 to R4. In these formulas, bb5 to bb8 represents the respective calculation results of the integration portion for the areas R1 to R4. in this embodiment, bb5=3.232×10$^{-9}$, bb6=1.678×10$^{-9}$, bb7=2.535×10$^{-8}$, and bb8=3.384×10$^{-9}$ are obtained. The magnetic energy density w2 when the magnet having a small magnetic force is used is represented by Formula (21E) and is obtained by totaling the calculation results of Formulas (21A) to (21D) and dividing this by the surface area of the areas R1 to R4. In the present embodiment, 3.347×10$^{-4}$ is obtained as the magnetic energy density w2.

$$bb5 = \int_{4\cdot10^{-3}}^{8\cdot10^{-3}} \int_0^{\frac{\pi}{2}} [(a5x\cdot r + b5x\cdot\theta + c5x\cdot r\cdot\theta + d5x)^2 + (a5y\cdot r + b5y\cdot\theta + c5y\cdot r\cdot\theta + d5y)^2]\cdot r\,d\theta\,dr \tag{21A}$$

$$bb6 = \int_0^{4\cdot10^{-3}} \int_0^{\frac{\pi}{2}} [(a6x\cdot r + b6x\cdot\theta + c6x\cdot r\cdot\theta + d6x)^2 + (a6y\cdot r + b6y\cdot\theta + c6y\cdot r\cdot\theta + d6y)^2]\cdot r\,d\theta\,dr \tag{21B}$$

$$bb7 = \int_{4\cdot10^{-3}}^{8\cdot10^{-3}} \int_{\frac{\pi}{2}}^{\pi} [(a7x\cdot r + b7x\cdot\theta + c7x\cdot r\cdot\theta + d7x)^2 + (a7y\cdot r + b7y\cdot\theta + c7y\cdot r\cdot\theta + d7y)^2]\cdot r\,d\theta\,dr \tag{21C}$$

$$bb8 = \int_0^{4\cdot10^{-3}} \int_{\frac{\pi}{2}}^{\pi} [(a8x\cdot r + b8x\cdot\theta + c8x\cdot r\cdot\theta + d8x)^2 + (a8y\cdot r + b8y\cdot\theta + c8y\cdot r\cdot\theta + d8y)^2]\cdot r\,d\theta\,dr \tag{21D}$$

$$w2 = \frac{(bb5 + bb6 + bb7 + bb8)}{\frac{(8\cdot10^{-3})^2\cdot\pi}{2}} \tag{21E}$$

The magnetic energy density was thus obtained in the manner described above.

Next, the coefficients of Formula (2) that represent the relationship between the illumination intensity and the magnetic energy density are determined.

Formula (22) below is obtained by re-expressing Formula (2) using the magnetic energy density when the magnet having a large magnetic force is used and the magnetic energy density when the magnet having a small magnetic force is used.

$$\left.\begin{aligned} E1 &= a\cdot w^2 + b\cdot w + c \\ E2 &= a\cdot w2^2 + b\cdot w2 + c \end{aligned}\right\} \tag{22}$$

Formula (23A) is obtained from the measurement values of the illumination intensity when the position from the end of the fluorescent tube is 200 mm. Moreover, when Formula (22) is re-expressed as a matrix formula, Formula (23B) is obtained. Formula (23C) is obtained from the formulas (23A) and (23B). The coefficients (a, b, and c) given by Formula (23C) give the coefficients of Formula (2) when the position from the end of the fluorescent tube is 200 mm.

$$\begin{bmatrix} E1 \\ E2 \\ E0 \end{bmatrix} = \begin{bmatrix} 2.672 \\ 2.345 \\ 2.196 \end{bmatrix} \tag{23A}$$

$$\begin{bmatrix} E1 \\ E2 \\ E0 \end{bmatrix} = \begin{bmatrix} w^2 & w & 1 \\ w2^2 & w2 & 1 \\ 0 & 0 & 1 \end{bmatrix} \cdot \begin{bmatrix} a \\ b \\ c \end{bmatrix} \tag{23B}$$

$$\begin{bmatrix} a \\ b \\ c \end{bmatrix} = \begin{bmatrix} 6.999\cdot10^4 \\ 421.75 \\ 2.196 \end{bmatrix} \tag{23C}$$

In the same way, Formula (24A) is obtained from the measurement values of the illumination intensity when the position from the end of the fluorescent tube is 150 mm. Moreover, when Formula (22) is re-expressed in this case as a matrix formula, Formula (24B) is obtained. Formula (24C) is obtained from Formula (24A) and Formula (24B). The coefficients (a1, b1, and c1) given by Formula (24C) give the coefficients of Formula (2) when the position from the end of the fluorescent tube is 150 mm.

As described above, in the present embodiment, the coefficients (a1, b1, and c1) when the position is 150 mm from the end of the fluorescent tube is used for the reason that there is little divergence in the illumination intensity.

$$\begin{bmatrix} E11 \\ E21 \\ E01 \end{bmatrix} = \begin{bmatrix} 2.757 \\ 2.404 \\ 2.192 \end{bmatrix} \tag{24A}$$

$$\begin{bmatrix} E1 \\ E2 \\ E0 \end{bmatrix} = \begin{bmatrix} w^2 & w & 1 \\ w2^2 & w2 & 1 \\ 0 & 0 & 1 \end{bmatrix} \cdot \begin{bmatrix} a1 \\ b1 \\ c1 \end{bmatrix} \tag{24B}$$

$$\begin{bmatrix} a1 \\ b1 \\ c1 \end{bmatrix} = \begin{bmatrix} -8.17\cdot10^4 \\ 660.749 \\ 2.192 \end{bmatrix} \tag{24C}$$

In the same way, Formula (25A) is obtained from the measurement values of the illumination intensity when the position from the end of the fluorescent tube is 100 mm. When Formula (22) is re-expressed in this case as a matrix formula, Formula (25B) is obtained. Formula (25C) is obtained from Formula (25A) and Formula (25B). The coefficients (a2, b2, and c2) given by Formula (25C) give the coefficients of Formula (2) when the position from the end of the fluorescent tube is 100 mm.

$$\begin{bmatrix} E12 \\ E22 \\ E02 \end{bmatrix} = \begin{bmatrix} 2.744 \\ 2.38 \\ 2.167 \end{bmatrix} \tag{25A}$$

$$\begin{bmatrix} E1 \\ E2 \\ E0 \end{bmatrix} = \begin{bmatrix} w^2 & w & 1 \\ w2^2 & w2 & 1 \\ 0 & 0 & 1 \end{bmatrix} \cdot \begin{bmatrix} a2 \\ b2 \\ c2 \end{bmatrix} \tag{25B}$$

$$\begin{bmatrix} a2 \\ b2 \\ c2 \end{bmatrix} = \begin{bmatrix} -6.701 \cdot 10^4 \\ 658.82 \\ 2.167 \end{bmatrix} \tag{25C}$$

What is claimed is:

1. A thermal printer comprising:

a thermal head which carries out a heating process on a thermal recording paper provided with color forming layers for performing color formation in a plurality of different colors; and a light fixing device which fixes images formed on the thermal recording paper by the heating process;

wherein the light fixing device comprises:

a hot cathode fluorescent lamp having a fluorescent tube that has a fluorescent coating applied to an inside surface of a glass tube and inside which are sealed mercury and noble gases, filament electrodes provided at both ends of the fluorescent tube, and lead wires that supply power to the filament electrodes; and a magnetic circuit that is provided on a side surface of the fluorescent tube and that generates a magnetic field that acts on current that flows through the fluorescent tube when power is fed to the filament electrodes.

2. A thermal printer according to claim 1, wherein the magnetic circuit comprises a frame formed with a U shaped cross section from a ferromagnetic material, and a pair of magnets positioned such that different polarities face each end of the frame, and wherein the magnetic circuit is mounted on a side surface of the fluorescent tube so as to surround a lower half of the fluorescent tube.

3. A thermal printer according to claim 2, wherein a reflective plate is disposed between an end portion of the magnets and the fluorescent tube.

4. A thermal printer according to claim 2, wherein a surface of the magnets that faces the fluorescent tube is curved in a shape that substantially corresponds to a surface of the fluorescent tube, and this curved surface forms the reflective plate.

5. A thermal printer according to claim 1, wherein the magnetic circuit comprises a frame formed with a U shaped cross section from a ferromagnetic material, and a pair of magnets provided at both ends of the frame, and wherein a plurality of the magnetic circuits are mounted in a row on a side surface of the fluorescent tube so as to surround a lower half of the fluorescent tube and so that polarities of adjacent magnets are different to each other.

6. A thermal printer according to claim 1, wherein the magnetic circuit comprises four magnets positioned at equal intervals along a peripheral surface of the fluorescent tube so that polarities of adjacent magnets are different to each other.

7. A thermal printer according to claim 1, wherein the magnetic circuit comprises a magnet shaped as a semicylinder, and more than half of an outer peripheral surface of the fluorescent tube is surrounded by a concave portion of the magnet.

8. A thermal printer according to claim 1, wherein the magnetic circuit comprises: a frame formed with a U shaped cross section from a ferromagnetic material and mounted so as to surround half a side surface of the hot cathode fluorescent lamp; and a pair of magnets positioned such that different polarities face each end of the frame and so as to sandwich one filament electrode of the hot cathode fluorescent lamp and a portion of the fluorescent tube.

9. A thermal printer according to claim 1, wherein the magnetic circuit comprises: a frame formed with a U shaped cross section from a ferromagnetic material and mounted so as to surround half a side surface of the hot cathode fluorescent lamp; and two pairs of magnets positioned such that different polarities face each end of the frame and so as to sandwich the filament electrodes at both ends of the hot cathode fluorescent lamp and a portion of the fluorescent tube.

10. A thermal printer according to claim 8, wherein a magnet used in the magnetic circuit is in a rectangular shape, a rectangular shape having one curved side, or a rectangular shape whose central portion has a different thickness to both end portions.

11. A thermal printer according to claim 1, wherein the magnetic circuit comprises: a frame formed with a U shaped cross section from a ferromagnetic material and mounted so as to surround half a side surface of the hot cathode fluorescent lamp; and a pair of magnets mounted at both ends of the frame so as to sandwich the fluorescent tube; and two pairs of magnets positioned at both ends of the frame so as to sandwich the filament electrodes at both ends of the hot cathode fluorescent lamp and a portion of the fluorescent tube.

12. A thermal printer according to claim 11, wherein a magnet used in the magnetic circuit is in a rectangular shape, a rectangular shape having one side formed in a wave shape, or a rectangular shape whose thickness is changed in a wave shape.

13. A thermal printer according to claim 1, wherein each of magnets used in the magnetic circuit is a ferrite magnet or a rare earth permanent magnet such as a samarium cobalt magnet.

14. A thermal printer according to claim 1, wherein each of magnets used in the magnetic circuit is an electromagnet formed from a soft porcelain material and a coil wound around the soft porcelain material.

15. A thermal printer according to claim 1, wherein the hot cathode fluorescent lamp is provided with a cooling fan at each end of the fluorescent tube for cooling the fluorescent tube.

16. A thermal printer according to claim 15, wherein the number of rotations of the cooling fan is controlled based on a surface temperature and illumination intensity of the fluorescent tube such that the illumination intensity is at maximum.

17. A thermal printer comprising:

a thermal head;

a moving device which moves thermal recording paper that is provided with color forming layers for performing color formation in a plurality of different colors in a first direction and in a second direction that is opposite to the first direction while the thermal recording paper is in a state of contact with the thermal head;

a first light fixing device provided at one side of the thermal head for fixing a first color; and a second light fixing device provided at another side of the thermal head for fixing a second color, wherein the first and second fixing device comprise:

a hot cathode fluorescent lamp having a fluorescent tube that has a fluorescent coating applied to an inside surface of a glass tube and inside which are sealed mercury and noble gases, filament electrodes provided at both ends of the fluorescent tube, and lead wires that supply power to the filament electrodes; and a magnetic circuit that is provided on a side surface of the fluorescent tube and that generates a magnetic field that acts on current that flows through the fluorescent tube when power is fed to the filament electrodes.

18. A thermal printer according to claim 17, wherein the moving device is formed from a first pinch roller and a first feed roller provided at one adjacent side portion of the a thermal head, a second pinch roller and a second feed roller provided at another adjacent side portion of the thermal head, and a pulse motor for driving the first and second feed rollers.

19. A thermal printer according to claim 18, the thermal printer further comprising:

a first sensor provided in the vicinity of the first pinch roller and the first feed roller for detecting a leading edge of thermal recording paper;

a second sensor provided in the vicinity of the second pinch roller and the second feed roller for detecting a leading edge of thermal recording paper; and a printing start position determining device which supplies the pulse motor with a pulse number that is in accordance with a distance that a printing start position of the thermal recording paper is to be moved in order to be directly below the thermal head, based on results of detections by the first sensor and second sensor.

20. A thermal printer according to claim 17, further comprising a shutter which shuts off light from the First light fixing device when fixing of the first color is completed.

21. A method of designing a hot cathode fluorescent tube comprising magnets for generating a magnetic filed which acts on an electron flow in the hot cathode fluorescent tube so as to increase an illumination intensity, the method comprising:

a first step of deriving an empirical formula for representing a relationship between illumination intensity and magnetic energy density from measurement values of illumination intensity and magnetic flux density inside the hot cathode fluorescent tube;

a second step of setting initial values for a shape of the magnet;

a third step of creating a model of the hot cathode fluorescent tube to be used for applying a finite element method;

a fourth step of deriving an evaluation coefficient that serves as an index for evaluating the shape of the magnet using the empirical formula; and a fifth step of applying the finite element method to the hot cathode fluorescent tube model, and optimizing the shape of the magnet that was set to the initial values using the evaluation coefficient.

22. A method of designing a hot cathode fluorescent tube according to claim 21, wherein, in the first step the magnetic flux density inside the hot cathode fluorescent tube and the illumination intensity when the magnet is mounted inside the hot cathode fluorescent tube are measured and the empirical formula is determined from the relationship between the illumination intensity and the magnetic flux density.

23. A method of designing a hot cathode fluorescent tube according to claim 21, wherein, in the fourth step, $\chi=(E_{obj}/E_{av}-1)^2$ is used as the evaluation coefficient when $E_{obj}$ is taken as the illumination intensity when the magnet is not mounted and $E_{av}$ is taken as the average illumination intensity when the magnet is mounted.

* * * * *